US011304508B2

(12) United States Patent
Bennett et al.

(10) Patent No.: US 11,304,508 B2
(45) Date of Patent: Apr. 19, 2022

(54) HEIGHT ADJUSTABLE TABLE AND COMPONENTS OF SAME

(71) Applicant: OMT-VEYHL USA CORPORATION, Holland, MI (US)

(72) Inventors: Peter Bennett, Holland, MI (US); Matthew Knudtson, Holland, MI (US); Anh Huynh, Holland, MI (US)

(73) Assignee: OMT—VEYHL USA Corporation, Holland, MI (US)

( * ) Notice: Subject to any disclaimer, the term of this patent is extended or adjusted under 35 U.S.C. 154(b) by 196 days.

(21) Appl. No.: 16/733,730

(22) Filed: Jan. 3, 2020

(65) Prior Publication Data

US 2020/0214439 A1 Jul. 9, 2020

Related U.S. Application Data

(60) Provisional application No. 62/789,705, filed on Jan. 8, 2019.

(51) Int. Cl.

| | |
|---|---|
| ***A47B 9/04*** | (2006.01) |
| ***A47B 9/20*** | (2006.01) |
| ***A47B 21/02*** | (2006.01) |
| ***A47B 13/02*** | (2006.01) |

(52) U.S. Cl.

CPC ..... *A47B 9/04* (2013.01); *A47B 9/20* (2013.01); *A47B 13/02* (2013.01); *A47B 21/02* (2013.01); *A47B 2200/0051* (2013.01); *A47B 2200/0056* (2013.01)

(58) Field of Classification Search

CPC .. A47B 9/04; A47B 9/20; A47B 21/02; A47B 2200/0051; A47B 2200/0052; A47B 2200/0056; A47B 2200/0057

See application file for complete search history.

(56) References Cited

U.S. PATENT DOCUMENTS 3,556,569 A * 1/1971 Bruhn ..... E04G 7/02 403/262
5,174,532 A * 12/1992 Huang ..... A47B 13/06 108/158.11
5,230,290 A * 7/1993 Crossman ..... A47B 9/04 108/147

(Continued)

*Primary Examiner* — Eret C McNichols

(74) *Attorney, Agent, or Firm* — Barnes & Thornburg LLP

(57) ABSTRACT

A height-adjustable table including a length-adjustable support, a motor assembly configured to drive adjustment of the length-adjustable support, a motor housing supporting the motor assembly. The length-adjustable support includes a telescopic column assembly comprising an exterior tube, an interior tube, and a spindle assembly. The spindle assembly includes spindle rod fixedly coupled to a first end of the exterior tube, the spindle rod being threadingly engaged with a spindle guide coupled to a first end of the interior tube, whereby rotation of the spindle rod causes the distance between the first ends to change in order to telescope the interior tube into or out of the exterior tube. Illustratively, force from rotation of the spindle rod is transferred through the spindle guide and into the first end of the interior tube. In illustrative embodiments, the spindle guide may extend through an aperture of a support plate coupled to the first end of the interior tube, thereby permitting transfer of force from the spindle rod to the interior tube.

7 Claims, 15 Drawing Sheets

(56) References Cited

U.S. PATENT DOCUMENTS 5,271,320 A * 12/1993 Reneau ..... A47B 9/04 100/147
5,322,025 A * 6/1994 Sherman ..... A47B 9/10 108/147
5,427,341 A * 6/1995 Gutgsell ..... A47B 13/06 248/188
6,152,430 A * 11/2000 Thoman ..... A63K 3/046 248/188
6,289,825 B1 * 9/2001 Long ..... A47B 9/00 108/147
6,474,619 B1 * 11/2002 Ma ..... A47B 9/20 248/631
6,935,250 B1 * 8/2005 Arnold ..... A47B 9/04 108/147
7,908,981 B2 * 3/2011 Agee ..... A47B 9/04 108/147
8,752,488 B2 * 6/2014 Moller ..... A47B 9/20 108/20
9,427,080 B2 * 8/2016 Wu ..... A47B 9/00
10,555,602 B1 * 2/2020 Lu ..... A47B 9/04
10,758,036 B2 * 9/2020 Lu ..... A47B 9/20
2002/0108544 A1 * 8/2002 Hsu ..... A47B 9/04 108/147.19
2003/0033963 A1 * 2/2003 Doyle ..... A47B 9/04 108/147.19
2006/0279143 A1 * 12/2006 Platz ..... A47B 9/04 310/51
2009/0121100 A1 * 5/2009 Waidelich ..... A47B 9/04 248/188.4
2011/0174101 A1 * 7/2011 Prottengeier ..... A47B 9/04 74/110
2012/0068635 A1 * 3/2012 Koch ..... A61G 7/012 318/135
2012/0126072 A1 * 5/2012 Pettersson ..... A47B 9/04 248/157
2015/0007756 A1 * 1/2015 Kollreider ..... A47B 9/20 108/21
2016/0345722 A1 * 12/2016 Chen ..... A47B 9/04
2017/0051869 A1 * 2/2017 Hsiao ..... F16M 11/18
2017/0224101 A1 * 8/2017 Bruder ..... A47B 13/06
2018/0140087 A1 * 5/2018 Wu ..... F16H 25/2056
2018/0172062 A1 * 6/2018 Hu ..... H02K 5/24
2018/0177288 A1 * 6/2018 Lin ..... H02K 7/06
2018/0184799 A1 * 7/2018 Lin ..... A47B 9/04
2019/0254418 A1 * 8/2019 Ryholl ..... A47B 21/02
2019/0357668 A1 * 11/2019 Knudtson ..... A47B 9/20
2019/0374023 A1 * 12/2019 Allen ..... A47B 17/02
2020/0229588 A1 * 7/2020 Chen ..... A47B 9/12
2020/0275772 A1 * 9/2020 Goldberg ..... A47B 13/08

* cited by examiner

HEIGHT ADJUSTABLE TABLE AND COMPONENTS OF SAME

CROSS REFERENCE TO RELATED APPLICATIONS

This application claims the benefit of priority under 35 U.S.C. § 119(e) to U.S. Provisional Patent Application No. 62/789,705, filed Jan. 8, 2019. The disclosure set forth in the referenced application is incorporated herein by reference in Its entirety.

FIELD OF THE INVENTION

The present invention relates generally to a height adjustable table, in particular a height-adjustable table utilizing telescoping length-adjustable support columns that include a spindle assembly, a motor assembly and a foot platform to support the support columns on a surface.

BACKGROUND

Pieces of furniture such as tables or office chairs must often be adjustable in height, e.g. the tabletop or seating surface. Towards this end, the legs of a table can, for example, be designed in a length-adjustable manner as telescopic supports. Locking means may be provided for fixing the extended position of a support, and thereby the height of the support, and to secure the support at its longitudinal extension in a set, extended position. For example, a splint may be inserted in bores provided along the longitudinal extension of the support. It is furthermore known that the support column itself may be designed as a spindle with a thread. The length adjustment can be implemented by unscrewing the spindle from a female support that is coupled to a portion of the tube profile.

A length-adjustable support can include one or more telescopic support columns, the support columns including an outer tube and an inner tube that telescopes into and out of the outer tube. The support columns may further include a spindle assembly that extends inside the tubes and includes a spindle rod that is rotated by a motor assembly to adjust the length of the support. An illustrative embodiment of a length adjustment support and spindle assembly is described in pending U.S. patent application Ser. No. 16/418,161 filed May 21, 2019, which claims priority to U.S. Provisional Patent Application No. 62/676,125, filed on May 24, 2018, the contents of which are incorporated herein.

Currently, the known height-adjustable tables, in particular, tables that include length-adjustable support columns mounted to a table top and coupled to a foot platform to support the support columns, often include utilization of multiple or complex/costly mechanisms or parts that require substantial manufacturing or prebuild. In some examples, certain components of a height-adjustable table may be included solely for the purpose of addressing the complexity of the mechanisms needed for the height-adjustable table to function properly. Further, such height-adjustable tables may require substantial or complex assembly procedures or processes in order to assemble the height-adjustable table for use by an end-user. The additional assembly time and complexity of the components required for such height-adjustable tables increases the cost and price of such tables, preventing them from being accessible to certain segments of the market. The task of this invention is to provide a height-adjustable table which avoids disadvantages of prior art.

SUMMARY

The present invention may comprise one or more of the features recited in the attached claims, and/or one or more of the following features and combinations thereof. In a first example aspect, a telescopic column assembly comprises an exterior column formed to include a central passage, the exterior column including a first end and a second end. The telescopic column assembly further comprises an interior column formed to be received within the central passage of the exterior column and including a second central passage, the interior column including a first end and a second end. The telescopic column assembly further comprises a spindle assembly comprising a spindle rod including a first end and a second end, wherein the first end of the spindle rod is retained in a fixed position adjacent the first end of the exterior column, and a spindle guide formed to include a spindle rod aperture, the spindle rod threadably engaging with the spindle rod aperture to permit the spindle guide to move along the spindle rod by rotation of the spindle rod. The spindle assembly further includes a support panel securing the spindle guide to the first end of the interior column. The telescopic column assembly is configured such that rotation of the spindle rod causes the distance between the first end of the exterior column and the first end of the interior column to increase, thereby causing the interior column to telescope out of the central passage of the exterior column.

A second example aspect includes the subject matter of the first example aspect, and wherein the spindle rod comprises an outside surface having male threading, and the spindle rod aperture of the spindle guide comprises female threading configured to mate with the male threading.

A third example aspect includes the subject matter of the first example aspect, and wherein the bushing assembly further comprises a spindle plate configured to be coupled to the spindle rod to rotate therewith.

A fourth example aspect includes the subject matter of the first example aspect, and wherein force from rotation of the spindle rod is transferred to the spindle guide, through the support panel, and into the first end of the interior column.

A fifth example aspect includes the subject matter of the first example aspect, and wherein the spindle guide is configured to extend through a spindle aperture in the support panel.

A sixth example aspect includes the subject matter of the fifth example aspect, and wherein the spindle guide is formed generally to include an abutment ledge that abuts against a top surface of the support panel when the spindle guide extends therethrough.

A seventh example aspect includes the subject matter of the sixth example aspect, and wherein the assembly further includes a retainer clip configured to partially surround the spindle guide and retain the spindle guide in the spindle aperture, the retainer clip configured to abut against a bottom surface of the support panel when the spindle guide extends therethrough.

An eighth example aspect includes the subject matter of the seventh example aspect, and wherein the retainer clip is generally a C-shaped clip that is made of flexible material.

A ninth example aspect includes the subject matter of the eighth example aspect, and wherein the retainer clip includes two teeth adjacent the ends of the retainer clip, each tooth configured to be received within a groove formed in a side surface of the spindle guide after the spindle guide is received within the spindle aperture.

In a tenth example aspect, a motorized length-adjustable support may comprise a motor assembly, a motor housing configured to support the motor assembly, and a telescopic column assembly. The telescopic column assembly may comprise an exterior tube coupled to the motor housing, the exterior tube including a central passageway. The telescopic column assembly may further comprise an interior tube that is configured to telescope into and out of the central passageway of the exterior tube, the interior tube formed to include a central passageway and including a support panel that extends across a portion of the central passageway. The telescopic column assembly may also comprise a spindle assembly, the spindle assembly comprising a spindle guide secured to the support panel of the interior tube, the spindle guide formed to include a spindle aperture comprising threading, and a spindle rod extending through the central passageway of the exterior tube and coupled to the motor assembly in the motor housing to be rotated by the motor assembly. The spindle rod is configured to extend through the spindle aperture of the spindle guide and threadingly engage with the spindle guide such that rotation of the spindle rod causes the spindle rod to travel through the spindle aperture, and wherein rotation of the spindle rod within the spindle guide to cause the interior tube to telescope into and out of the central passageway of the exterior tube.

An eleventh example aspect includes the subject matter of the tenth example aspect, and wherein the interior tube includes a first end, a second end, and a tube housing extending between the first end and the second end, and wherein the first end is positioned between the second end and the motor housing.

A twelfth example aspect includes the subject matter of the eleventh example aspect, and wherein the support panel of the interior tube is coupled to the tube housing adjacent the first end.

A thirteen example aspect includes the subject matter of the twelfth example aspect, and wherein force from rotation of the spindle rod is transferred to the first end of the interior tube through the support panel.

A fourteenth example aspect includes the subject matter of the tenth example aspect, and wherein the support panel includes a spindle-assembly aperture, and the spindle guide extends through the spindle-assembly aperture.

A fifteenth example aspect includes the subject matter of the fourteenth example aspect, and wherein the spindle guide is secured within the spindle-assembly aperture by a retainer clip that extends around a portion of a circumference of the spindle guide.

A sixteenth example aspect includes the subject matter of the fifteenth example aspect, and wherein the retainer clip includes at least one tooth that engages with a groove in a side surface of the spindle guide to connect the retainer clip to the spindle guide.

A seventeenth example aspect includes the subject matter of the eleventh example aspect, and wherein the support further includes a foot platform coupled to the second end of the interior tube, wherein the foot platform is not directly connected to the spindle assembly.

An eighteenth example aspect includes the subject matter of the seventeenth example aspect, and wherein the interior tube further includes a locating tab coupled to the tube housing adjacent the second end of the interior tube and wherein the locating tab is configured to align with and extend through a locating slot of the foot platform when coupling the foot platform to the interior tube.

A nineteenth example aspect includes the subject matter of the seventeenth example aspect, and wherein the interior tube further includes a mounting plate adjacent the second end of the interior tube that extends across a portion of the central passageway, the mounting plate including a tube fastener aperture to receive a fastener, and wherein the tube fastener aperture is configured to align with a foot fastener aperture extending through the foot platform to permit connection of the foot platform to the interior tube.

A twentieth example aspect includes the subject matter of the nineteenth example aspect, and wherein the interior tube further includes a locating tab coupled to a first side of the tube housing along the second end of the interior tube, and wherein the fastener aperture of the mounting plate is adjacent a second side of the tube housing.

DESCRIPTION OF THE ILLUSTRATIVE EMBODIMENTS

For the purposes of promoting an understanding of the principles of the invention, reference will now be made to a number of illustrative embodiments shown in the attached drawings and specific language will be used to describe the same. The figures of the drawings show the object according to the invention are strongly schematized and are not to be taken to scale. The individual components of the object according to the invention are represented such that their design can be easily seen.

As described herein the present disclosure is directed to a length-adjustable support with one or more telescopic support columns configured to form a height-adjustable table. The support columns include an outer tube and an inner tube that telescopes into and out of the outer tube. The support further includes a spindle assembly that extends inside the tubes and includes a spindle rod that is rotated by a motor assembly to adjust the length of the support. The spindle assembly may be configured to be coupled to the inner tube of the support column such that force from the rotating spindle rod is applied to a portion or component of the inner tube to cause the rotation spindle rod to rotate with respect to the inner tube to telescope out of the inner tube. The length-adjustable support is further configured to include a foot platform to retain the support in a fixed position on a flat surface, with the support and foot platform including a location and securement feature that locks the two components together with minimal assembly time and materials.

Figure 1:
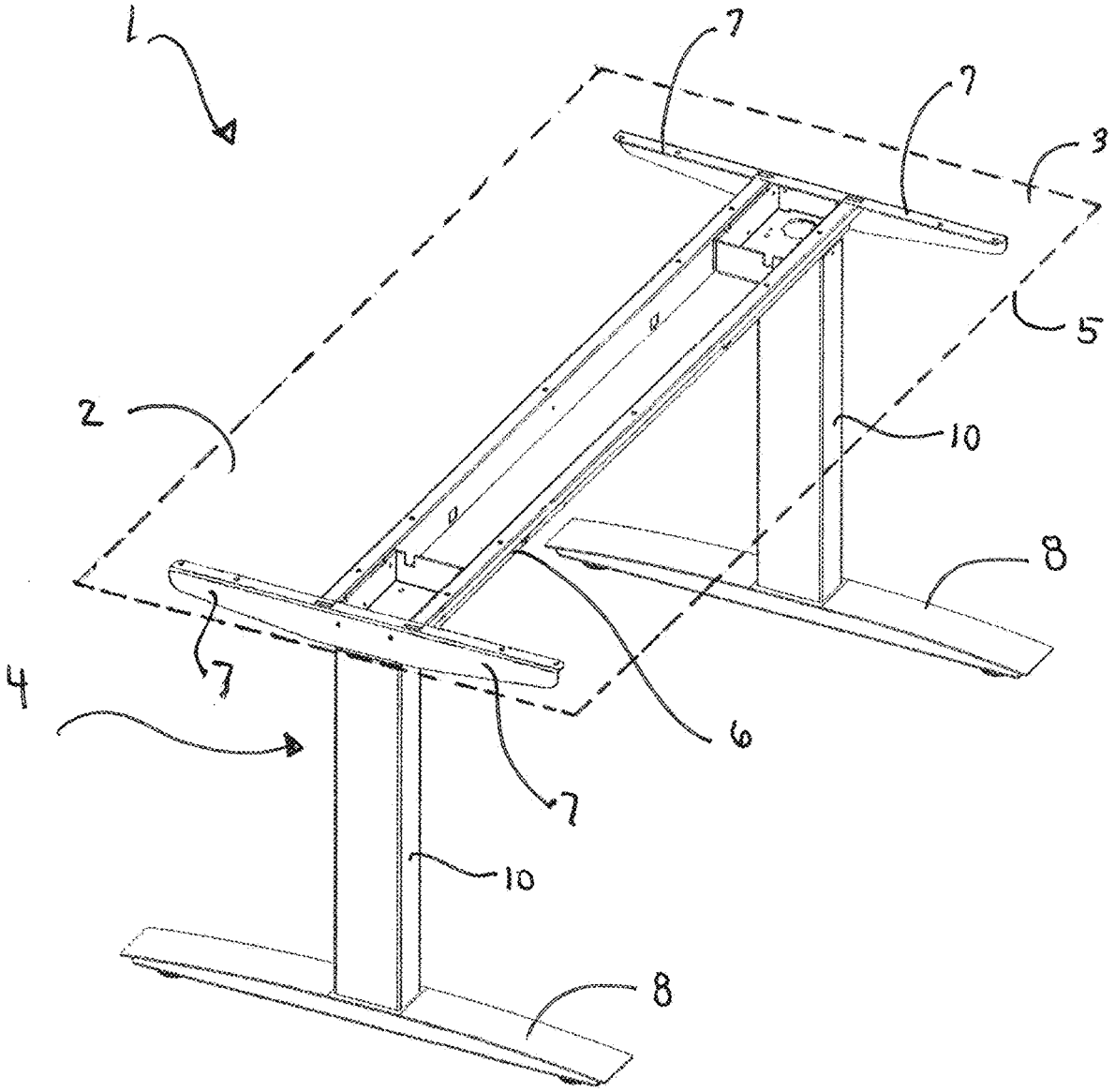
FIG. 1 is a top perspective view of a height-adjustable table of the present disclosure that includes a top (in phantom) coupled to a top support assembly that retains the top, the top support assembly including a top support, a motor housing, two length-adjustable supports coupled to the top support and configured to adjust in length as controlled by a motor in the motor housing, and a foot platform coupled to the bottom of the length-adjustable supports.

FIG. 1 illustrates an exemplary embodiment of a height-adjustable table assembly 1. The height-adjustable table assembly 1 illustratively includes a table top 2 and a base assembly 4. The table top 2 (which is shown in phantom) includes a top surface 3 and a bottom surface 5, and the base assembly 4 is configured to be secured to the bottom surface 5 of the table top 2 to maintain the table top 2 in a predetermined or desired position above a ground surface (not shown). Specifically, the base assembly is configured to raise or lower the table top 2 to a position desired by a user, particularly one or more positions that are comfortable or ergonomically aligned with a user in a sitting position and/or a standing position, in order to permit a user to individualize the height of top surface 3 upon which the user is performing a task.

As illustrated in FIG. 1, the base assembly 4 of the height-adjustable table assembly 1 includes one or more support braces 6 coupled to the bottom surface 5 of the table top 2, one or more foot platforms 8 configured to stabilize the base assembly 4 on a ground surface, and one or more length-adjustable supports 10, shown in general representation but discussed in detail below, extending between the support braces 6 and the foot platforms 8. In an illustrative embodiment as shown in FIG. 1, the height-adjustable table 1 includes a support brace 6 with two support arms 7 extending generally perpendicularly to the length of the support brace 6 to secure the support brace to the bottom surface 5 of the table top 2, two length-adjustable supports 10 that are configured to couple to the support brace 6 adjacent the support arms 7, and two foot platforms 8 that are coupled to the bottom free end of the two length-adjustable supports 10. In various embodiments, there may be two or more length-adjustable supports 10 coupled to a support brace 6 and a table top 2 to form a table assembly 1. In various embodiments the supports 10 may alternatively be coupled directly to the table top 2 via one or more set screws (not shown).

Figure 2A:
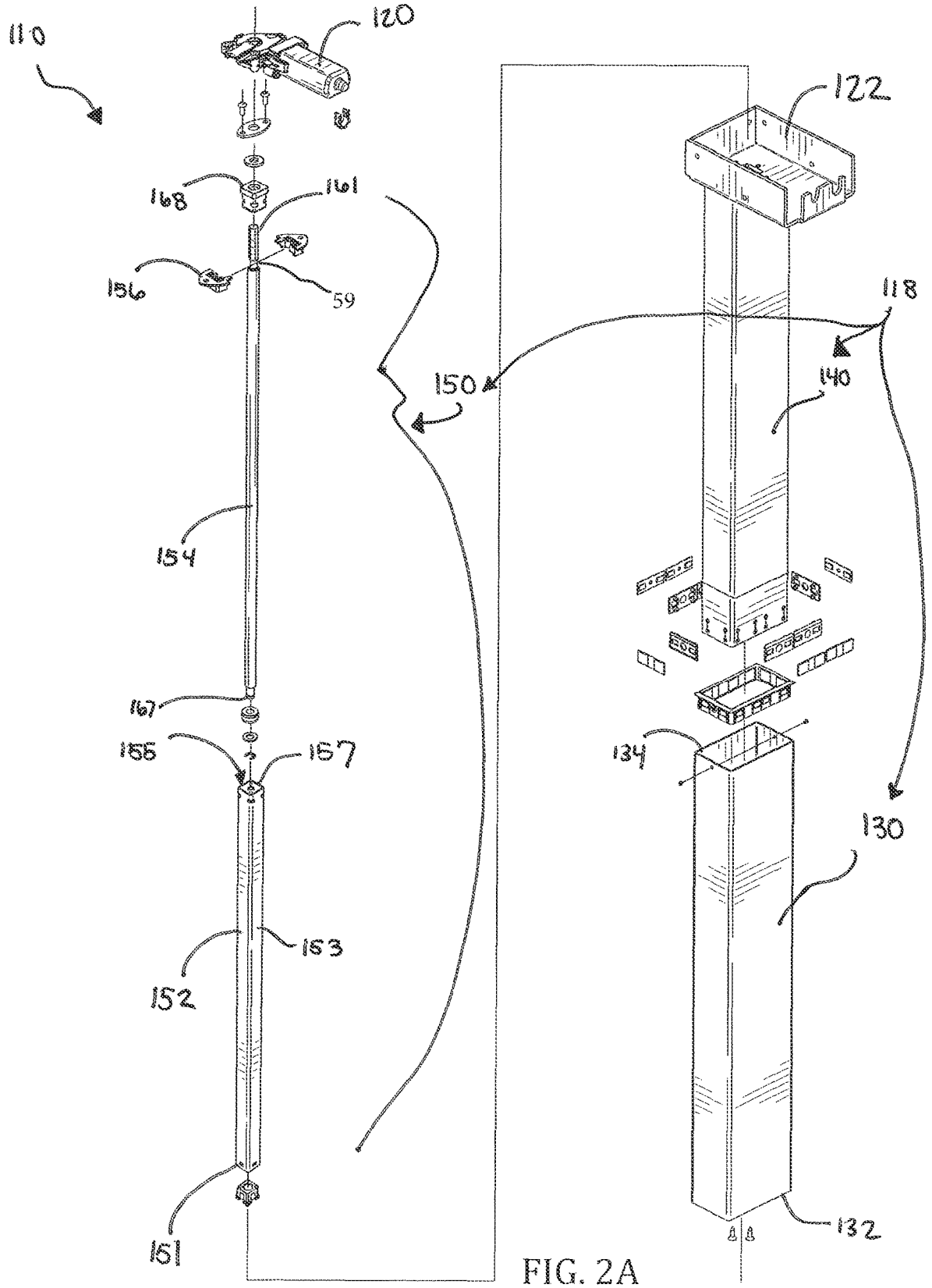
FIG. 2A (PRIOR ART)
FIG. 2A is an exploded view of a known length-adjustable support of a height-adjustable table, illustrating a spindle assembly is received within a telescopic column assembly and is engaged by a motor that is received in a motor housing to permit adjustment of the length-adjustable support, and illustrating the spindle assembly includes a rod that travels through a spindle guide to telescope out of a spindle housing and a bushing assembly is coupled to a top section of the rod to connect the rod to the motor housing.
Figure 2B:
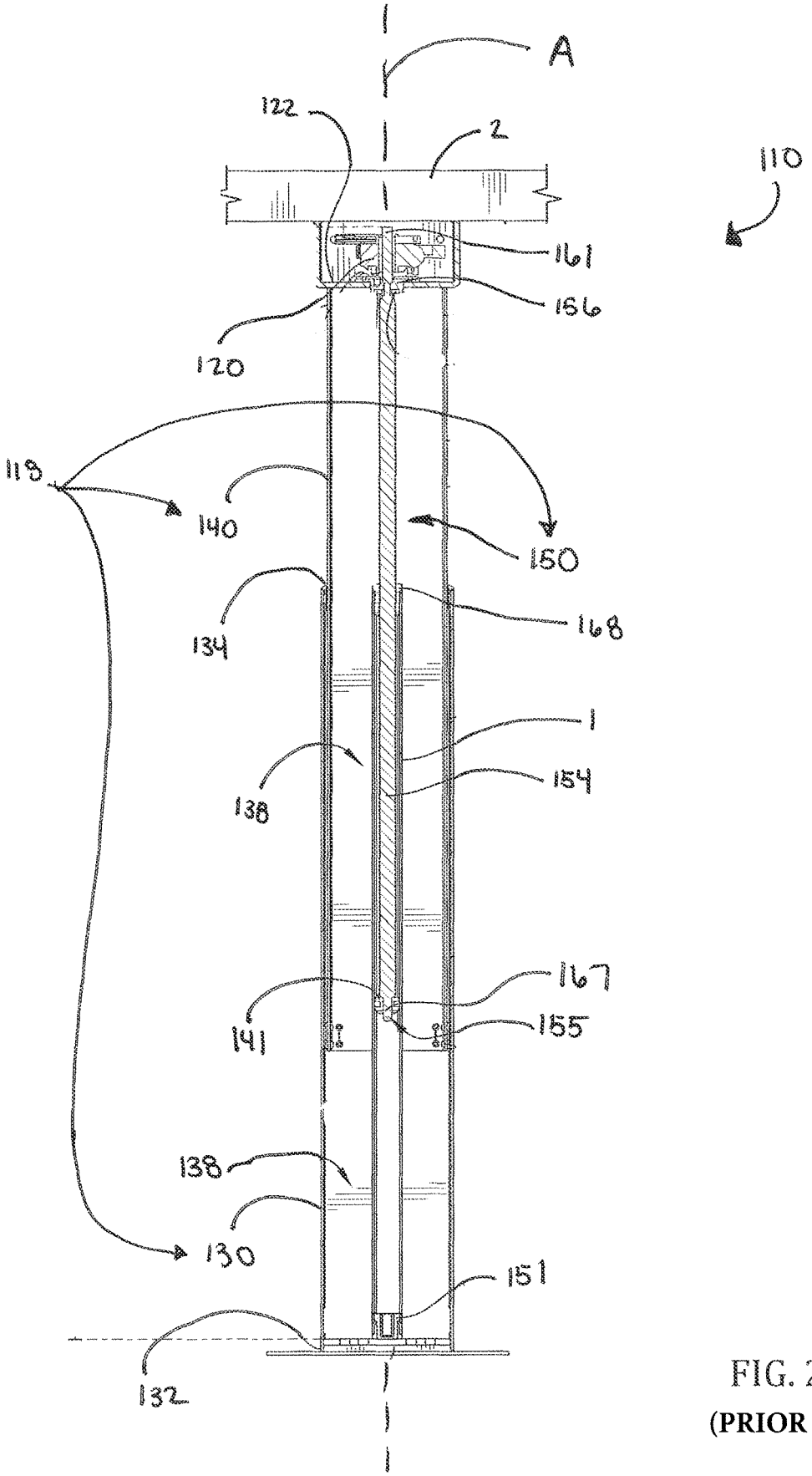
FIG. 2B (PRIOR ART)
FIG. 2B is a front perspective, cross-sectional view of the known length-adjustable support of FIG. 2A, showing the support in an extended position, illustrating the spindle housing of the spindle assembly is fixed to a bottom of the telescopic column assembly, and further illustrating the spindle rod telescopes out of the spindle housing in order to extend the telescopic column assembly to the extended position.

Referring now to FIGS. 2A to 2B, an illustrative embodiment of a known length-adjustable support 110 similar to that disclosed in U.S. patent application Ser. No. 16/418,161 filed May 21, 2019, which claims priority to U.S. Provisional Patent Application No. 62/676,125, filed May 24, 2018 and incorporated by reference herein, is shown. Such known length-adjustable supports 110 may be configured to include a motor assembly 120, a motor housing 122, and a column assembly 118. The column assembly 118 includes an exterior tube 130, an interior tube 140, and a spindle assembly 150 configured to cause the interior tube 140 to telescope into and out of the exterior tube 130 in order to adjust the length of the length-adjustable support 110.

More specifically, the spindle assembly 150 of the known length-adjustable support 110 includes a spindle tube 152, a spindle rod 154, a bushing assembly 156, and a spindle guide 168. The spindle tube 152 of the spindle assembly 150 includes a spindle housing 153 that forms a central passageway 155 through which a spindle rod 154 extends, and the spindle housing extends a substantial length within an interior passage 138 of the interior tube or exterior tubes 140 or 130 along a spindle axis A of the spindle assembly 150. The motor assembly 120 is configured to rotate a top end 161 of the spindle rod 154 to cause the spindle rod to telescope into and out of the spindle tube 152 via the spindle guide 168. In various embodiments, a rod bumper 141 may be positioned along a second end 167 of the spindle rod 152 to facilitate travel of the spindle rod 154 within the spindle tube 152. A first end 151 of the spindle tube 152 is attached to a bottom end 132 of the lower tube (e.g. exterior tube 30) of the column assembly 118. A second end 207 of the spindle tube 152 generally corresponds in location with an opposite top end 134 of the lower tube. The spindle tube 152 will be maintained within the exterior tube 130 but will be telescoped down and out of the interior tube 140 when the column assembly 118 is telescoped, that is when the inner tube 140 is telescoped up and out of the exterior tube 30, to increase the height of the length-adjustable support 110, as suggested by FIG. 2B.

Figure 3A:
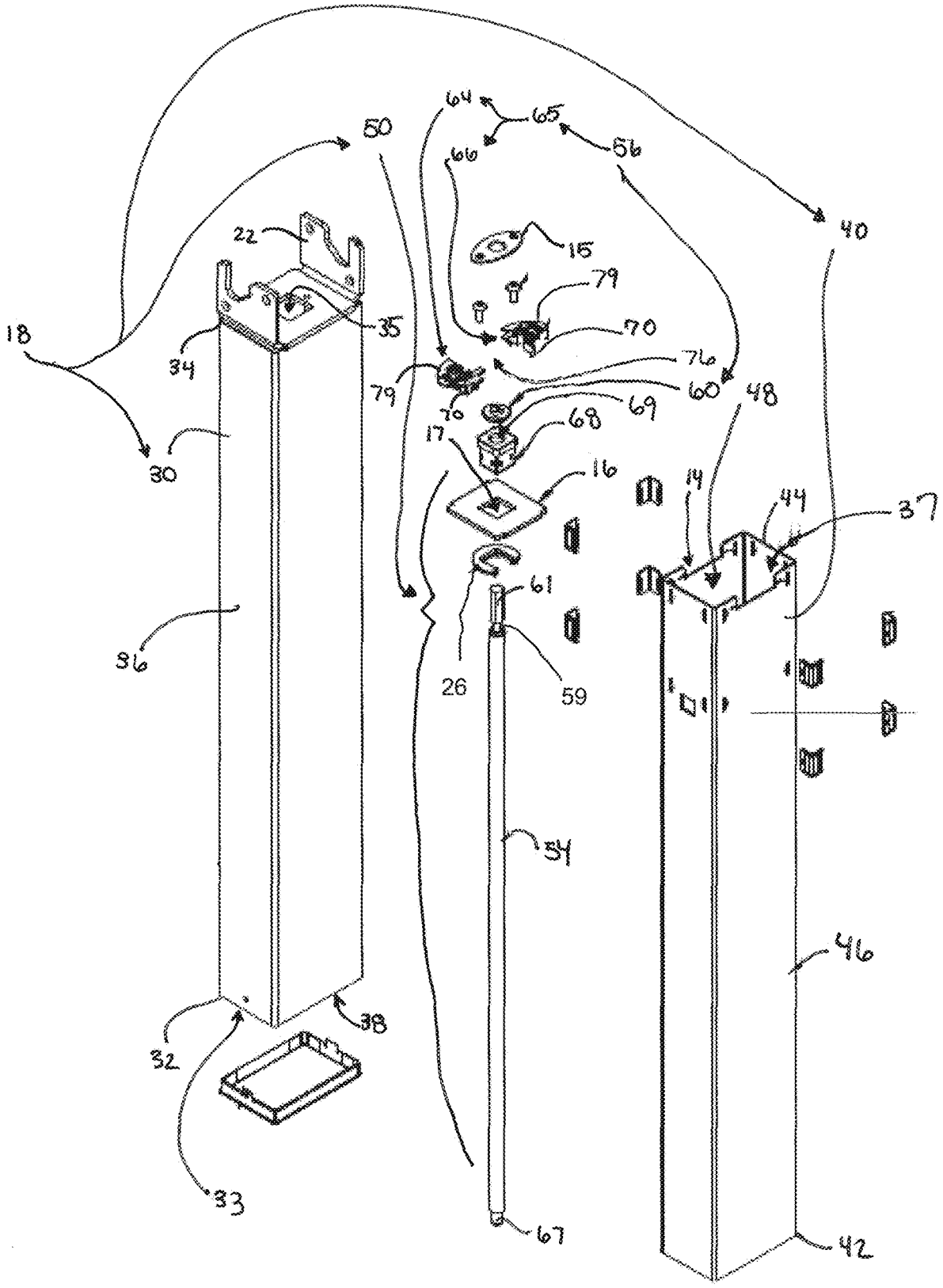
FIG. 3A is an exploded view of an exemplary embodiment of the length-adjustable support of the present disclosure, illustrating a spindle assembly is received within a telescopic column assembly, the spindle assembly including a rod that telescopes within a portion of the telescopic column assembly and a spindle guide secured around a portion of the rod to permit rotation of the rod within the spindle guide, and further illustrating a support panel will be coupled to and surround the spindle guide to secure the spindle guide to an inner tube of the column assembly.
Figure 3B:
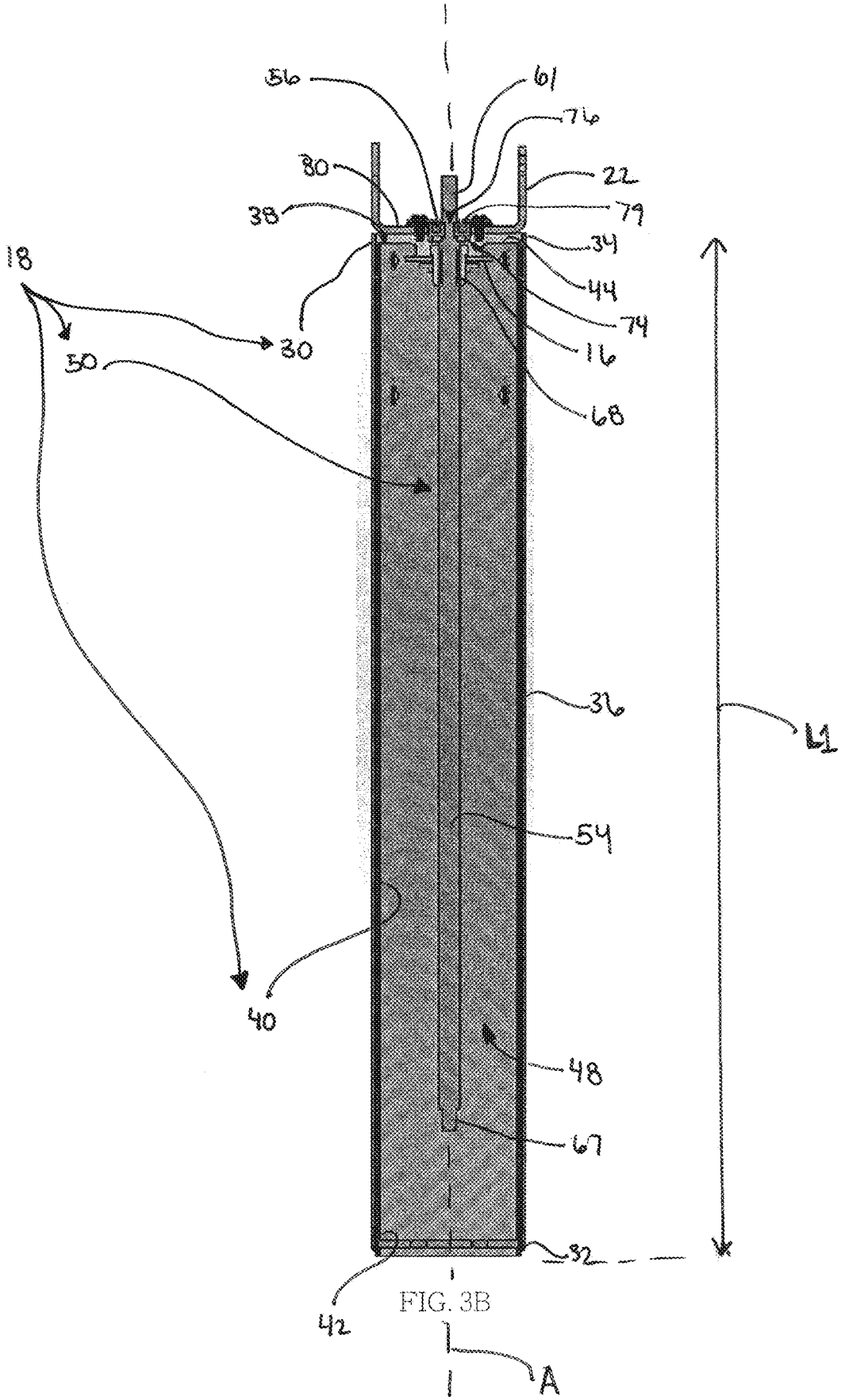
FIG. 3B is a front perspective, cross-sectional illustrative view of a length-adjustable support of FIG. 3A in an assembled configuration, showing the support in a collapsed position, illustrating the rod of the spindle assembly is configured to extend through the spindle guide and through the column assembly such that a top portion of the rod is coupled to a motor housing connected to a top of the height-adjustable table, and illustrating that the support panel retaining the spindle guide of the spindle assembly is secured to an upper end of an interior tube of the column assembly.
Figure 3C:
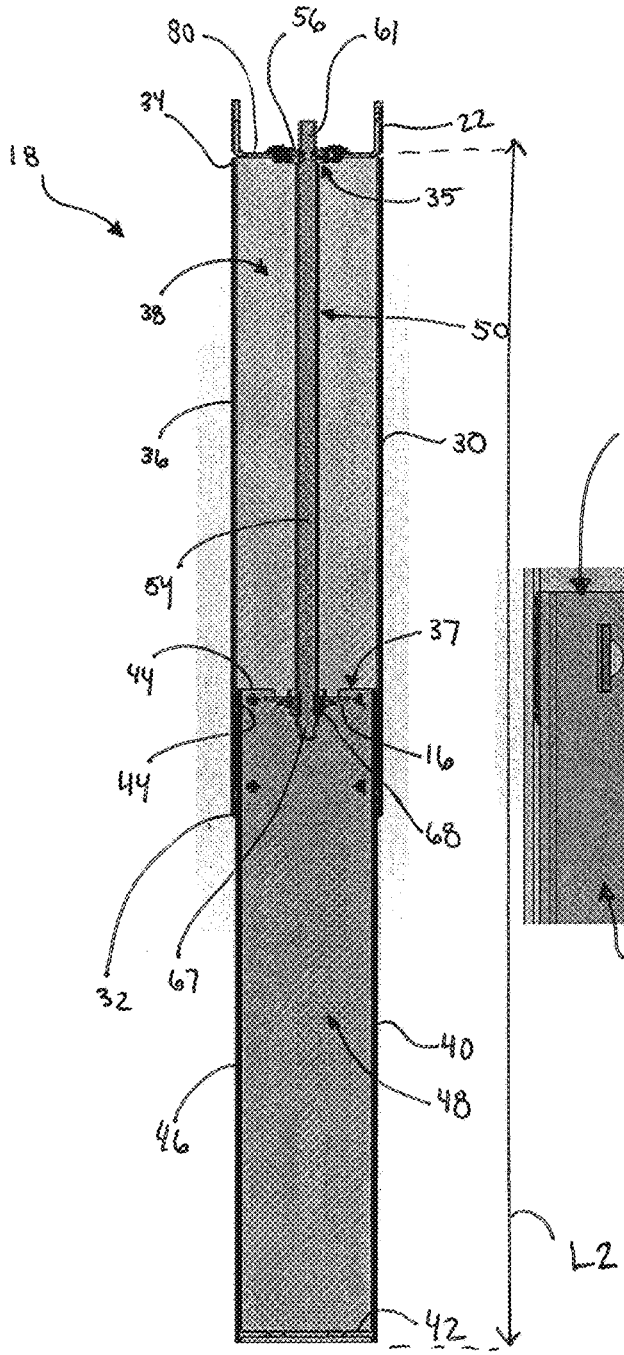
FIG. 3C is a front perspective, cross-sectional view of the length-adjustable support of FIG. 3B, showing the support after it has been moved from the collapsed position to an extended position, and illustrating the rod of the spindle assembly has been rotated to telescope through the spindle guide and out of the interior tube in order to extend the telescopic column assembly to the extended position.
Figure 3D:
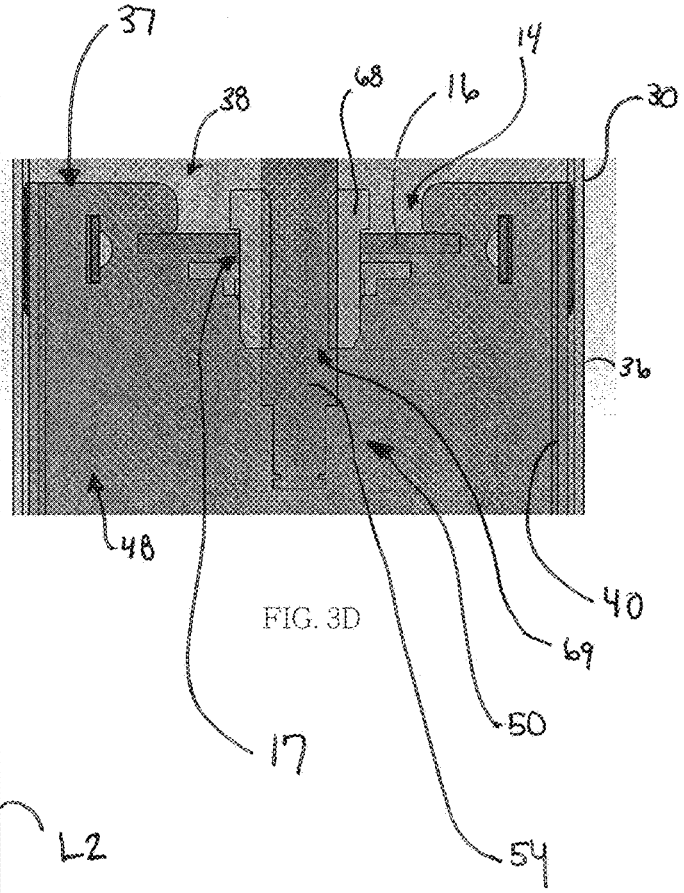
FIG. 3D is a detailed view of the cross-sectional view of FIG. 3C, illustrating the spindle guide with the spindle rod extending therethrough and the support panel coupled to the spindle guide.
Figure 4:
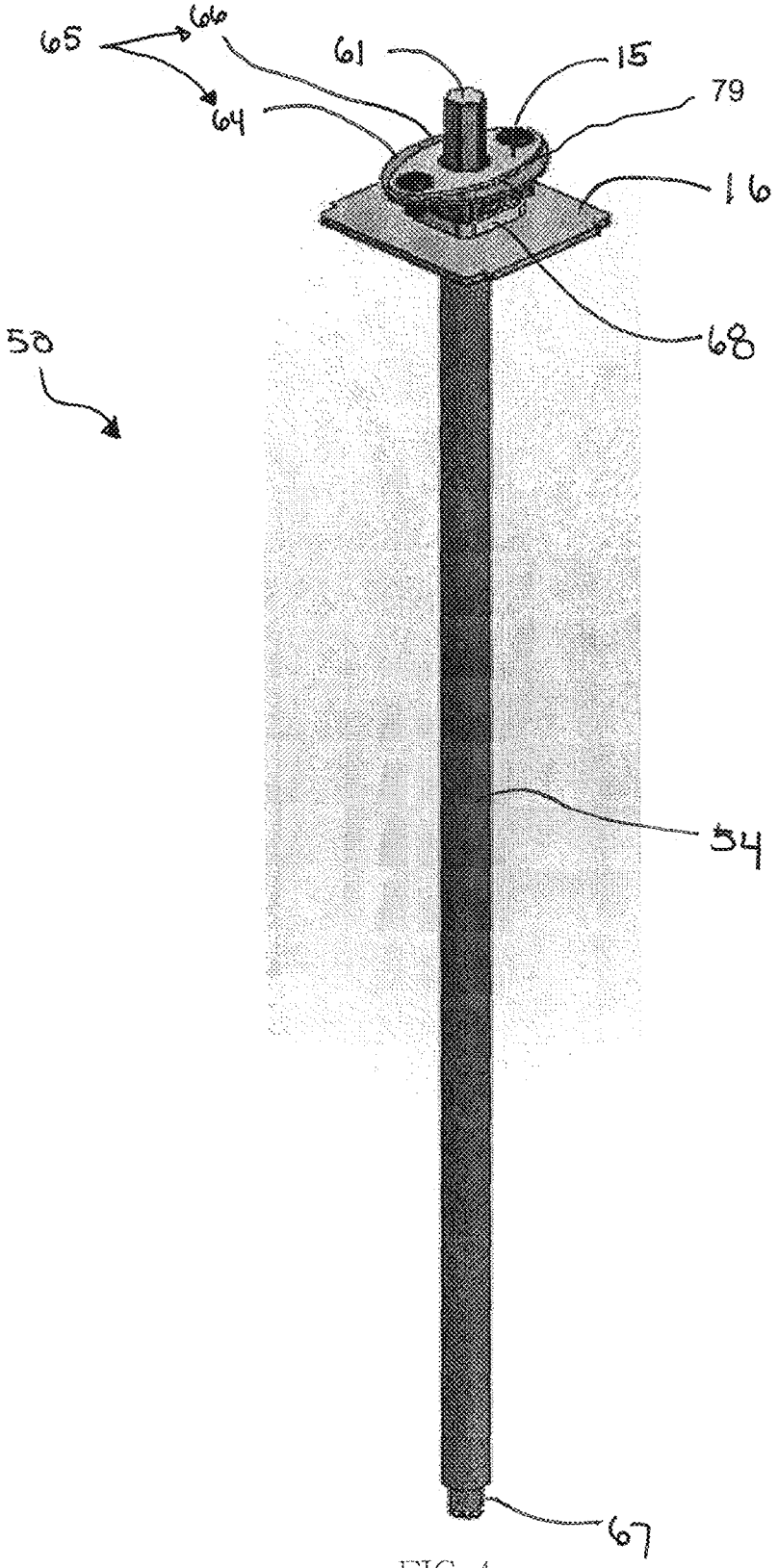
FIG. 4 is side perspective view of the spindle assembly and support panel of FIG. 3A, illustrating connection of the spindle rod to the spindle guide and further illustrating the spindle assembly includes a bushing assembly that permits the spindle rod to be coupled to the motor housing in order to permit rotation of the spindle rod therethrough to adjust the length of the telescopic column assembly.

FIGS. 3A to 3C illustrate an exemplary embodiment of one length-adjustable support 10 of the present disclosure. Although FIG. 1 illustrates two length-adjustable supports 10 as part of the height adjustable table assembly 1, such supports 10 may be considered substantially identical and therefore only one such support 10 will be described in detail herein.

In illustrative embodiments, the support 10 of the table assembly 1 includes a telescopic column assembly 18, a motor assembly (not shown, but similar to the motor assembly 120 described above), and a motor housing 22, as illustrated. The motor assembly is configured to cause the telescopic column assembly 18 to convert from a collapsed position to an extended position to adjust the length of the support 10 in order to, for example, adjust the height of the top surface 3 of the table top 2. In particular, the motor assembly is configured to drive portions of the column assembly 18, discussed below, to telescope with respect to each other to change the length of the column assembly 18. The motor housing 22 is configured to house a portion of the motor assembly and may be coupled to the bottom surface 5 of the table top 2 or to the support brace 6 of the base assembly 4. In various embodiments, the column assembly 18 is configured to extend between the foot platform 8 and the motor housing 22 and be coupled thereto.

An illustrative embodiment of the column assembly 18 will now be described. As illustrated in FIGS. 3A-3C, the column assembly 18 includes an upper exterior tube 30, a lower interior tube 40 configured to telescopically extend into and out of the exterior tube 30, and a spindle assembly 50 configured to extend through a portion of the exterior and interior tubes 30 and 40. A portion of the spindle assembly 50 is connected to both the exterior tube 30 and the interior tube 40. The spindle assembly 50 is configured to be driven by the motor assembly in order to cause the interior tube 40 to telescope out of the exterior tube 30, driving the exterior tube 30 up from the interior tube 40 in order to adjust the length of the column assembly 18. Accordingly, the exterior tube 30 may be configured to telescopically extend over the interior tube 40. The spindle assembly 50 may be configured to be attached to the platform 8 that is attached to a bottom portion of the interior tube 40.

In illustrative embodiments, the exterior tube 30 includes a first end 32, a second end 34 and a tube housing 36 that extends between the first and second ends 32 and 34. The tube housing 36 defines a central passage 38 of the exterior tube 30 that extends from the first end 32 to the second end 34. The central passage 38 is configured to receive the interior tube 40 such that the tube housing 36 surrounds the interior tube 40 when the column assembly 18 is in the collapsed state. The first end 32 of the exterior tube 30 is illustratively configured to be near the foot platform 8 when the column assembly 18 is in a collapsed state, as illustrated in FIG. 3B, but it is not coupled or otherwise connected to the foot platform 8. The second end 34 of the exterior tube 30 is configured to be near the motor housing 22 to be illustratively coupled thereto or formed homogenously therewith. The first end 32 of the exterior tube 30 is formed with an opening 33 through which the interior tube 40 telescopes as it travels from the central passage 38 in order to extend the length of the column assembly 18. The second end 34 of the exterior tube 30 is formed with a spindle opening 35 through which the spindle assembly 50 is coupled to the motor assembly in the motor housing 22 to permit rotation or operation of the spindle assembly 50.

The interior tube 40 includes a first end 42, a second end 44, and a tube housing 46 that extends between the first and second ends 42 and 44. The tube housing 46 is configured to be received within the central passage 38 of the exterior tube 30 when the interior tube 40 is telescoped within the exterior tube 30. In illustrative embodiments, the tube housing 46 of the interior tube 40 is similar in shape or dimension as the tube housing 36 of the exterior tube 30, although the tube housing 46 may be necessarily smaller than the tube housing 36. The tube housing 46 defines a central passage 48 of the interior tube 40 that extends from the first end 42 to the second end 44. The central passage 48 is configured to receive the spindle assembly 50 such that the tube housing 46 surrounds the spindle assembly 50. The first end 42 of the interior tube 40 is configured to be near the first end 32 of the exterior tube 30 when the column assembly 18 is in the collapsed state, as illustrated in FIG. 3A. The first end 42 of the interior tube 40 is illustratively coupled to the foot platform 8, or the foot platform 8 may be homogenously formed with the first end 42. Similarly, the second end 44 of the interior tube 40 is configured to be near the second end 34 of the exterior tube 30 when the column assembly 18 is in the collapsed state, as illustrated in FIG. 3A. However, the interior tube 40 is configured to be movable within the central passage 38 of the exterior tube 30 such that the first end 42 (and foot platform 8 attached thereto) is moved away from the first end 32 of the exterior tube 30 when the interior tube 40 telescopes out of the exterior tube 30. Similarly, the second end 44 is moved away from the second end 34 when telescoping occurs. The spindle assembly 50 extends through the second end 44 of the interior tube 40 such that the second end 44 provides an opening 37 into the central passage 48. The first end 42 may be substantially enclosed, or may also include an opening into the central passage 48.

In illustrative embodiments, the interior tube 40 may further include a support panel 16 coupled to the second end 44 that spans or extends across the opening 37 into the central passage 48. The support panel 16 may be substantially sized to fill the opening 37, and may formed homogenously with the second end 44 or be formed separately and coupled thereto. For instance, the support panel 16 may be received within one or more seat openings 14 in the tube housing 46 and a portion of the tube housing 46 may be crimped or altered to retain the support panel 16 in a fixed position in the seat opening 14. The support panel 16 may also be secured to the tube housing 46 via clips or other forms of retainers incorporated into the tube housing 46 and/or support panel 16. The support panel 16 is configured with a spindle-assembly aperture 17 that permits the spindle assembly 50 to extend therethrough and be coupled to the support panel 16 to secure the spindle assembly 50 to the interior tube 40. The tube housing 46 of the interior tube 40 accordingly supports the weight and operation of the spindle assembly 50 via the support panel 16. The support panel 16 therefore provides a load transfer mechanism of force from the spindle assembly 50 to the foot platform 8 (and the ground surface) through the second end 44 of the interior tube 40.

The spindle assembly 50 is coupled to both the exterior tube 30 and the interior tube 40 and is configured to be driven by the motor assembly to telescope the interior tube 40 down and out of the central passage 38 of the exterior tube 30. In illustrative embodiments, the spindle assembly 50 is configured to extend from the motor housing 22 through the spindle opening 35 in the second end 34 of the exterior tube 30 and into the central passage 38 of the exterior tube 40. Functionally, because the exterior tube 30 is coupled to the motor housing 22 and the motor assembly within the housing retains a portion of the spindle assembly 50, a portion of the spindle assembly 50 is coupled to the second end 34 of the exterior tube 30. Another portion of the spindle assembly 50 is coupled to the second end 44 of the interior tube 40 via the support panel 16. The spindle assembly 50 is not directly connected to the first end 42 of the interior tube 40 or the foot platform 8.

As suggested by FIGS. 3B-3C, the column assembly 18 is configured to extend in length from a first length L1 to a second length L2 when the spindle assembly 50 extends out of the interior tube 40, thereby causing the interior tube 40 to telescope down and out of the exterior tube 30 to extend the length of the column assembly 18. The spindle assembly 50 and column assembly 18 are generally positioned along or surrounding a spindle axis A. The spindle axis A generally defines the direction of travel for the column assembly 18 as it telescopes to extend or retract in length.

The spindle assembly 50 includes a spindle rod 54, a spindle guide 68, and a bushing assembly 56, as illustrated in FIGS. 3A-3C. The spindle rod 54 is configured to be received within the central passage 48 of the interior tube 40 and extends substantially along spindle axis A. The spindle rod 54 is configured to rotate within the central passage 48 during operation of the spindle assembly 50 to change the length of the length-adjustable support 10. In particular, rotation of the spindle rod 54 is configured to telescope the spindle rod 54 into and out of the central passage 48 of the interior tube 40 as the interior tube 40 telescopes into and out of the central passage 38 of the exterior tube 30.

As illustrated in FIGS. 3A-3C, the spindle rod 54 is configured to be attached to the motor housing 22, which in turn is attached to the exterior tube 30. The spindle rod 54 includes a first end 61 and a second end 67. The first end 61 may generally correspond in location with the motor housing 22 that is adjacent the second end 34 of the exterior tube 30. The second end 67 may generally correspond in location with the first end 42 of the interior tube 40 when the length-adjustment support 10 is in the collapsed position, but may be moved away from the first end 42 when the spindle assembly 50 is moved to an extended position. For instance, the second end 67 is not secured to the first end 42 of the interior tube 40 or the foot platform 8.

In illustrative embodiments, the spindle guide 68 is illustratively coupled to the support panel 16 attached to the first end 42 of the interior tube 40. The spindle guide 68 is configured to receive the spindle rod 54 while permitting the spindle rod 54 to move with respect to the interior tube 40. The spindle guide 68 may be positioned adjacent the first end 42 of the interior tube 40, or may alternatively be located at other locations along the length of the interior tube 40. The spindle guide 68 illustratively provides a guide means for the spindle rod 54 as it telescopes within the interior tube 40 by providing engagement between the interior tube 40 via the spindle guide 68 and the spindle rod 54.

Illustratively, the spindle guide 68 includes a central passage 69 that is formed by an interior surface 63 of the spindle guide 68 to permit the spindle rod 54 to pass through. The interior surface 63 of the spindle guide 68 is configured to engage with a mating section of the spindle rod 54 to permit the spindle rod 54 to rotate within the spindle guide 68 as the spindle guide 68 remains substantially fixed and coupled to the support panel 16. In illustrative embodiments, the mating section of the spindle rod 54 includes male threading and the interior surface 63 of the spindle guide 68 includes female threading that receives the male threading of the spindle rod 54. As the spindle rod 54 rotates, the male threading travels through the female threading, effectively lengthening or reducing the distance from the first end 61 of the spindle rod 54 (and therefore the motor housing 22) to the support panel 16 (and therefore the second end 44 of the interior tube 40). Length adjustment of the spindle assembly 50 may accordingly be achieved.

As discussed, in an exemplary embodiment, the spindle guide 68 may be coupled to and configured to engage with the second end 44 of the interior tube 40 to provide the spindle rod 54 passage into the central passage 48 of the interior tube 40. Accordingly, the spindle rod 54 may be inserted through the central passage 69 of the spindle guide 68 and the central passage 48 of the interior tube 40. The spindle guide 68 is configured to permit transfer of the force from the spindle rod 54 to the interior tube 40.

Figure 5A:
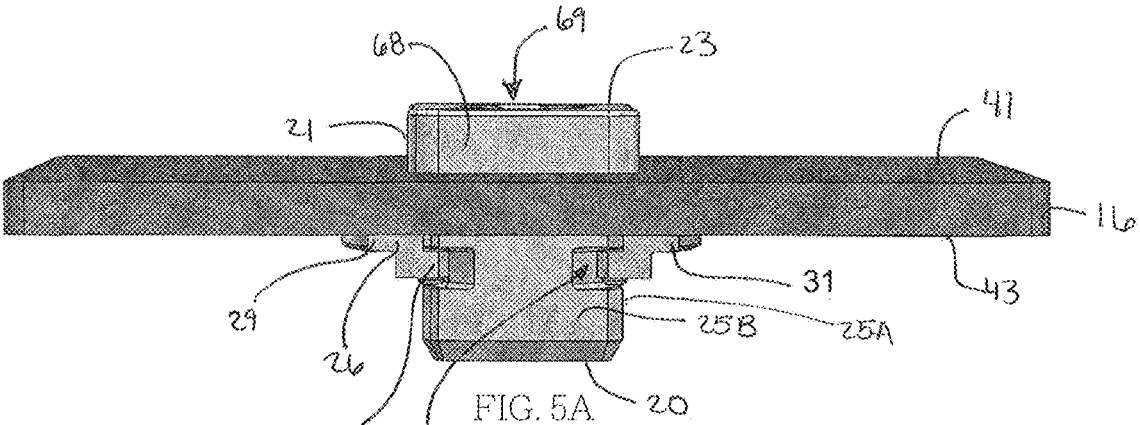
FIG. 5A is a side perspective assembled view of the spindle guide and support panel of FIG. 4 and further illustrating the spindle guide is secured in an aperture of the support panel by a retainer that is received within a side wall of the spindle guide and extends against the support panel to prevent movement of the spindle guide through the aperture.
Figure 5B:
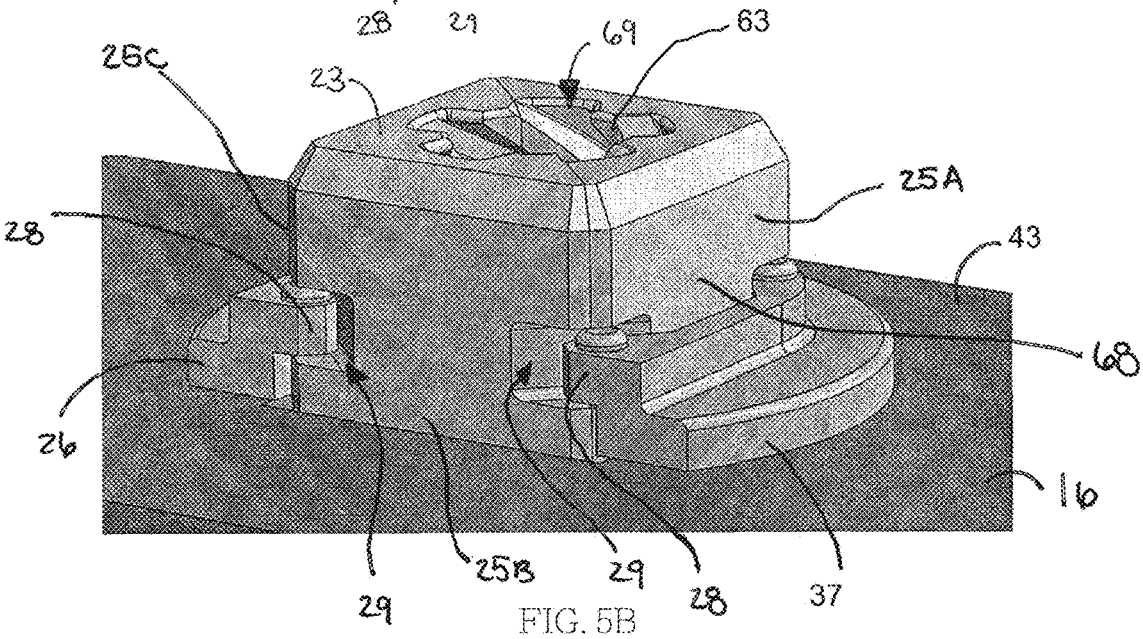
FIG. 5B is a detailed bottom perspective view of the components of FIG. 5A, illustrating engagement of teeth of the retainer with grooves in the side wall of the spindle guide to prevent movement.
Figure 5C:
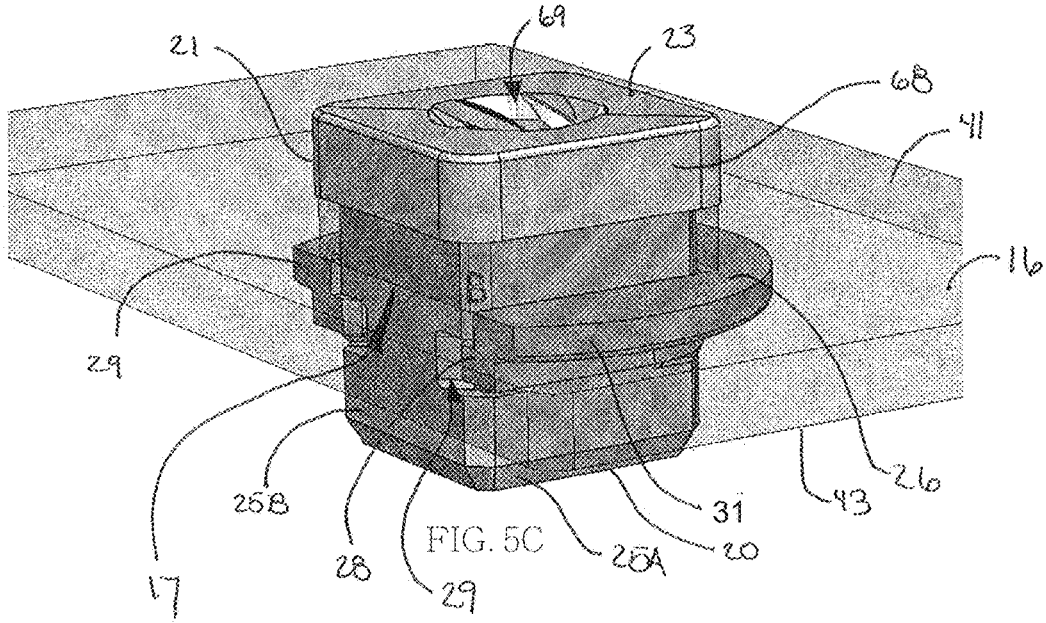
FIG. 5C is a detailed top perspective view of the components of FIG. 5A with the support panel in transparent view, and illustrating the spindle guide includes a top ledge that retains the spindle guide within the aperture of the support panel.
Figure 6B:
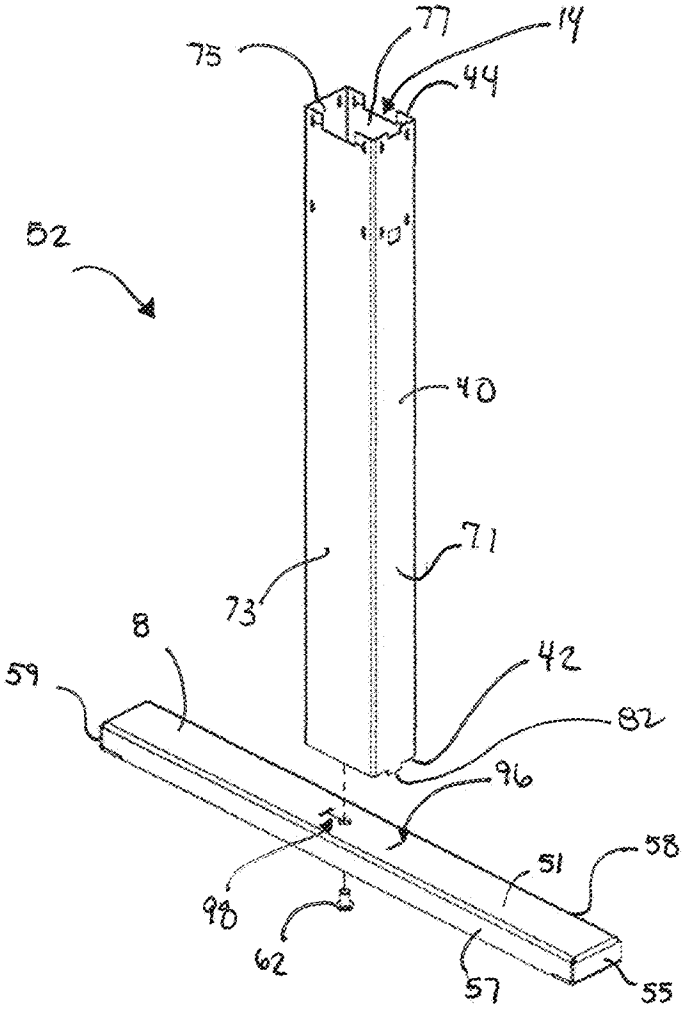
FIG. 6B is an exploded view of a foot-and-column assembly of FIG. 6A, illustrating the column assembly is configured to be coupled to the foot assembly via a fastener or other similar mechanism that extends through the foot assembly.
Figure 6A:
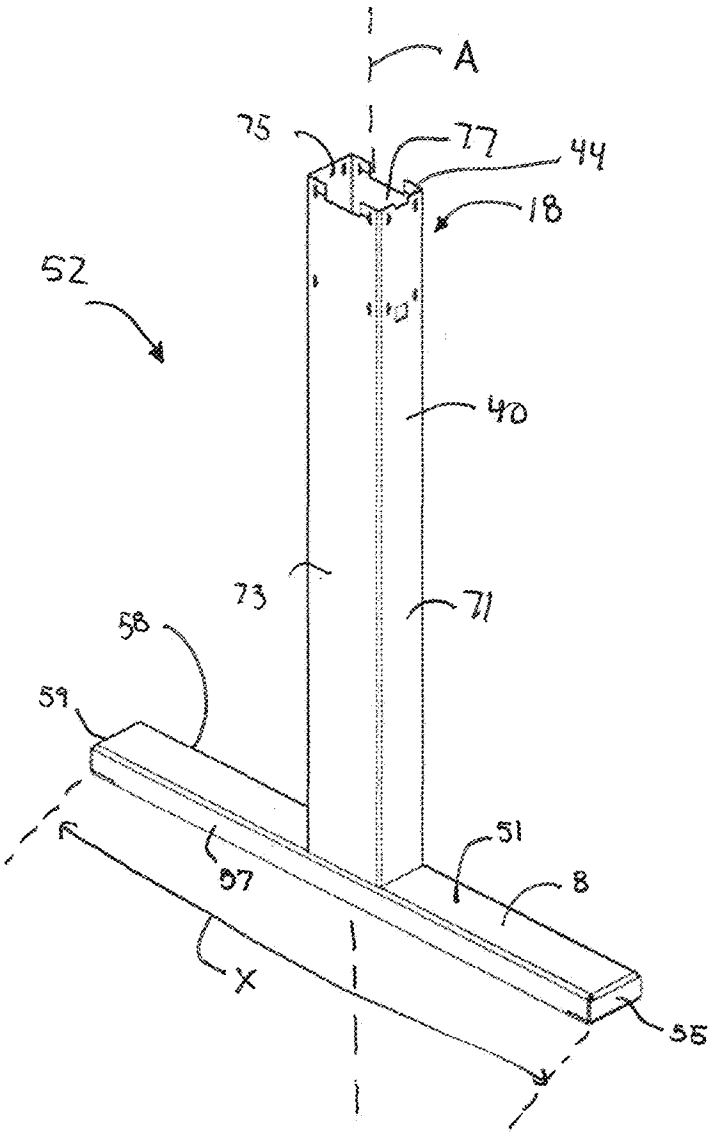
FIG. 6A is a side perspective view of a foot-and-column assembly of the height-adjustable table of the present disclosure, illustrating the foot-and-column assembly includes a foot platform configured to maintain the height-adjustable table on a solid surface and a portion of a column assembly that is coupled to the foot platform.

The spindle guide 68 is configured to be retained within the aperture 17 of the support panel 16 via at least a retainer clip 26. The retainer clip 26 may be configured in various shapes, but illustratively may be configured as a C-shaped clip with an inner perimeter that is shaped to mate with an exterior surface of the spindle guide 68. As illustrated in FIGS. 5A-5C, the spindle guide 68 may illustratively be shaped similar to a cube having a first end 23, a second end 20 and exterior side surfaces 25A, 25B, 25C, and 25D. The central passage 69 of the spindle guide 68 through which the spindle rod 54 travels may extend from the first end 23 to the second end 20. In illustrative embodiments, the first end 23 of the spindle guide 68 includes an abutment ledge 21 that extends radially outward from the exterior side surfaces 25A-25D. The abutment ledge 21 is configured to be slightly larger in diameter than the aperture 17 of the support panel 16, so that when the spindle guide 68 is positioned within the aperture 17, the ledge 21 abuts against a top surface 41 of the support panel 16 to prevent the spindle guide 68 from sliding all the way through the aperture 17.

The retainer clip 26 is a semi-flexible component that may be biased to a position that retains the spindle guide 68 in a fixed position relative to the support panel 16. Specifically, the retainer clip 26 configured to mate with a portion of one or more of the side surfaces 25A-25D of the spindle guide 68. As illustrated in FIGS. 5A-5C, the retainer clip 26 includes one or more radially-inward extending ledges or teeth 28 that are configured to be received by one or more grooves 29 formed in one or more side surfaces 25A-25D of the spindle guide 68. The retainer clip 26 can therefore be connected to the spindle guide 68 by inserting the teeth 28 into the grooves 29. The retainer clip 26 further includes a radially-outward extending support ledge 31 that has a diameter that is greater than the diameter of the aperture 17 of the support panel 16. Accordingly, when spindle guide 68 is positioned within the aperture 17 of the support panel 16 and the ledge 21 abuts against the top surface 41 of the support panel 16, the grooves 29 in the spindle guide 68 are positioned below a bottom surface 43 of the support panel 16. The retainer clip 26 can then be connected to the spindle guide 68 adjacent the bottom surface 43 of the support panel via the teeth 28 engaging with the grooves 29, and the support ledge 31 of the retainer clip 26 will abut against the bottom surface 43 to prevent movement of the spindle guide 68.

Other means of securing the spindle guide 68 to the interior tube 40 to permit transfer of force from the spindle rod 54 to the interior tube 40 are envisioned herein. Alternatively, the spindle guide 68 may be integrally formed with the support panel 16, and then coupled to the first end 42 of the interior tube 40.

In assembly, the second end 67 of the spindle rod 54 may be threadingly received within the central passage 69 of the spindle guide 68 and then pass into the central passage 48 of the interior tube 40. The spindle rod 54 may be rotated in order to be inserted into the central passage 48 in order to cause the male and female threading to engage with each other. The spindle rod 54 may be rotated until a predetermined length of male threading is traversed. This may occur when the length-adjustment support 10 is in the collapsed state, for example.

Illustratively, the spindle rod 54 is received by a spindle driver (not shown) of the motor assembly that is contained within the motor housing 22 (which in turn is secured to the exterior tube 30), as illustrated in FIG. 3B. Accordingly, as the spindle rod 54 is driven out of the interior tube 40, for example, by the motor assembly, the spindle rod 54 and inner tube 40 combined extend in length, causing the motor housing 22 to move upward and the interior tube 40 to telescope down and out of the exterior tube 30, increasing the length of the length-adjustment support 10.

In an illustrative embodiment, the spindle rod 54 is coupled to the motor housing 22 via at least the bushing assembly 56. The bushing assembly 56 includes a bushing member 65 and a spindle plate 60 that is receivable by the bushing member 65. The bushing member 65 is configured to permit rotation of the spindle rod 54 therethrough. The spindle plate 60 is configured to surround the spindle rod 54 below the bushing member 65 and may be positioned adjacent the spindle rod 54. In various embodiments, the spindle plate 60 could be a washer, hex washer or ring, although other embodiments are envisioned herein. The bushing member 65 may be comprised of metal, plastic or other suitable material, and the spindle plate 60 may be comprised of metal, plastic or other suitable material. Both the bushing member 65 and the spindle plate 60 are configured to be aligned around the spindle axis A.

In illustrative embodiments, the bushing member 65 is formed by a first bushing component 64 and a second bushing component 66. The first and second bushing components 64 and 66 are complimentary to each other and configured to be joined together to surround the spindle rod 54 and permit the spindle rod 54 to rotate between the components 64 and 66. In one embodiment, the bushing components 64 and 66 may be secured together via one or more clips 70 that extend from the first bushing component 64 and are retained by the second bushing component 66. Other means to secure the two bushing components 64 and 66 are envisioned herein. The first and second bushing components 64 and 66 each include a spindle recess configured such that coupling of the first and second bushing components 64 and 66 causes the spindle recesses to form a circular spindle aperture 76 through which the spindle rod 54 extends and can rotate. The spindle aperture 76 is sized and configured to permit rotation of a portion 59 of the spindle rod 54 within the bushing member 65, but is not large enough to permit the first end 61 of the spindle rod 54 engaging with the motor assembly to extend therethrough. Accordingly, the spindle rod 54 will be blocked from sliding or slipping completely through the bushing member 65.

The first and second bushing components 64 and 66 are configured to be secured together around the spindle rod 54 within the motor housing 22. As illustrated in FIG. 3B, the spindle rod 54 is configured to extend and slide through a spindle aperture 74 within a bottom side 80 of the motor housing 22 in order to be received within the exterior tube 30 and interior tube 40. In illustrative embodiments, the first and second bushing components 64 and 66 are coupled together to form the bushing member 65 within the motor housing 22 and provide a top surface 79 perimeter that is larger than the spindle aperture 74. Accordingly, a top portion of the bushing member 65 may abut against the bottom side 80 of the motor housing 22 to prevent the spindle assembly 50 from traveling through the spindle aperture 74. A support plate 15 may be provided to add strength to the bushing member 65 (which may be comprised of plastic) during application of force upon the bushing member 65 during operation of the length-adjustment support. The support plate 15 may be formed of metal in illustrative embodiments, although other materials are envisioned herein, and the support plate 15 may include a support aperture 39 through which the spindle rod 54 can extend.

An exemplary embodiment of a foot-and-column assembly 52 of the height-adjustable table 1 of the present disclosure is illustrated in FIGS. 6A-10B. As illustrated, the foot-and-column assembly 52 includes a portion of the column assembly 18, such as the lower interior tube 40, the foot platform 8, and a fastener 62 such as a set screw or other similar mechanism configured to secure the interior tube 40 to the foot platform 8. The interior tube 40 may be coupled to the foot platform 8 at any portion along a length X of the foot platform 8, but illustratively may be coupled generally in the middle of the foot platform 8. In such an embodiment, as the interior tube 40 may be positioned generally along the spindle axis A, the spindle axis A may extend generally through the middle of the platform 8, although other embodiments are envisioned herein. The foot platform 8 and interior tube 40 may be configured of various sizes and shapes, depending on the functionality and aesthetics of the height-adjustable table 1.

Figure 7:
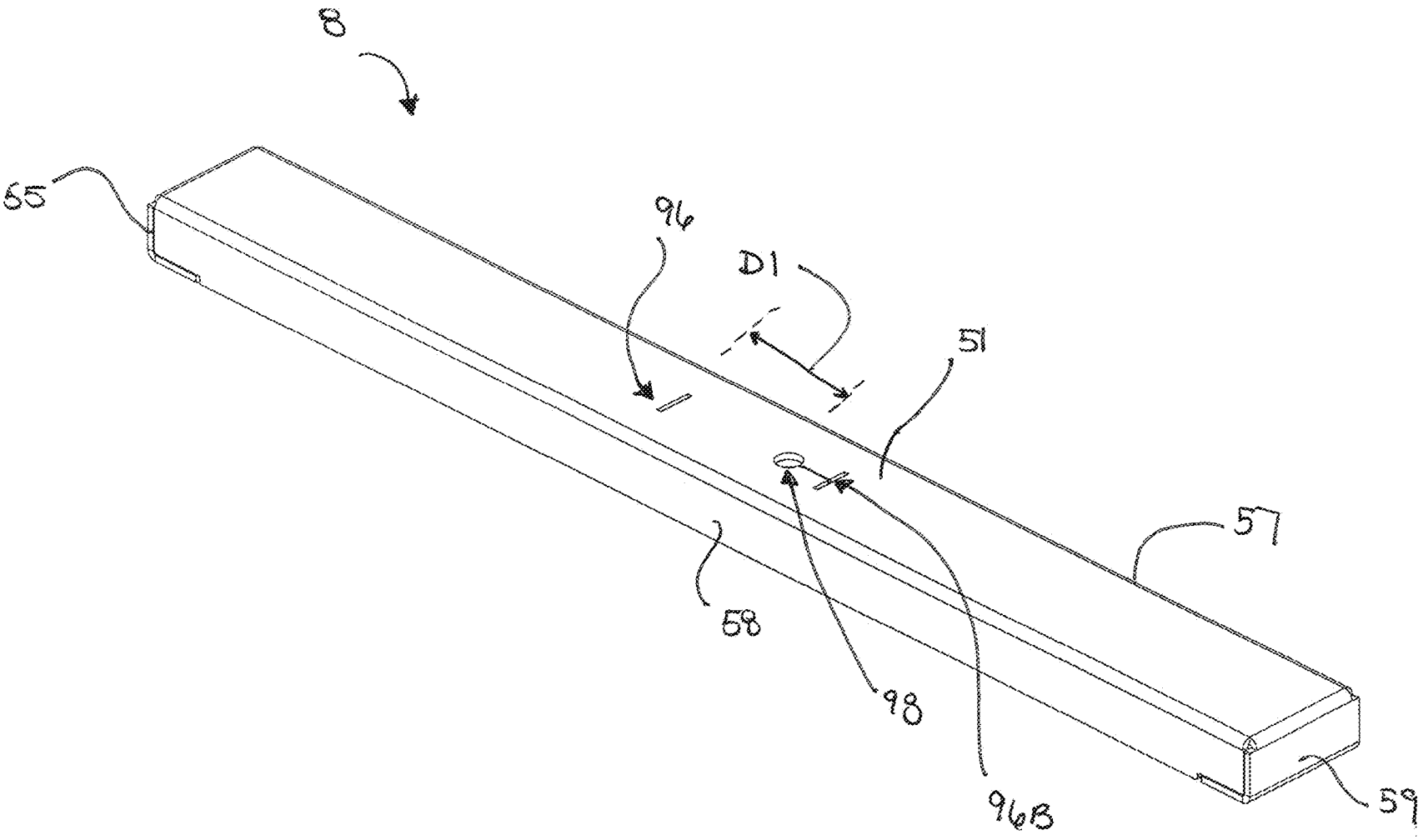
FIG. 7 is a side perspective view of the foot platform of FIG. 6B, the foot platform including a locating slot and fastener aperture for receiving a portion of the column assembly of the height-adjustable table.
Figure 9B:
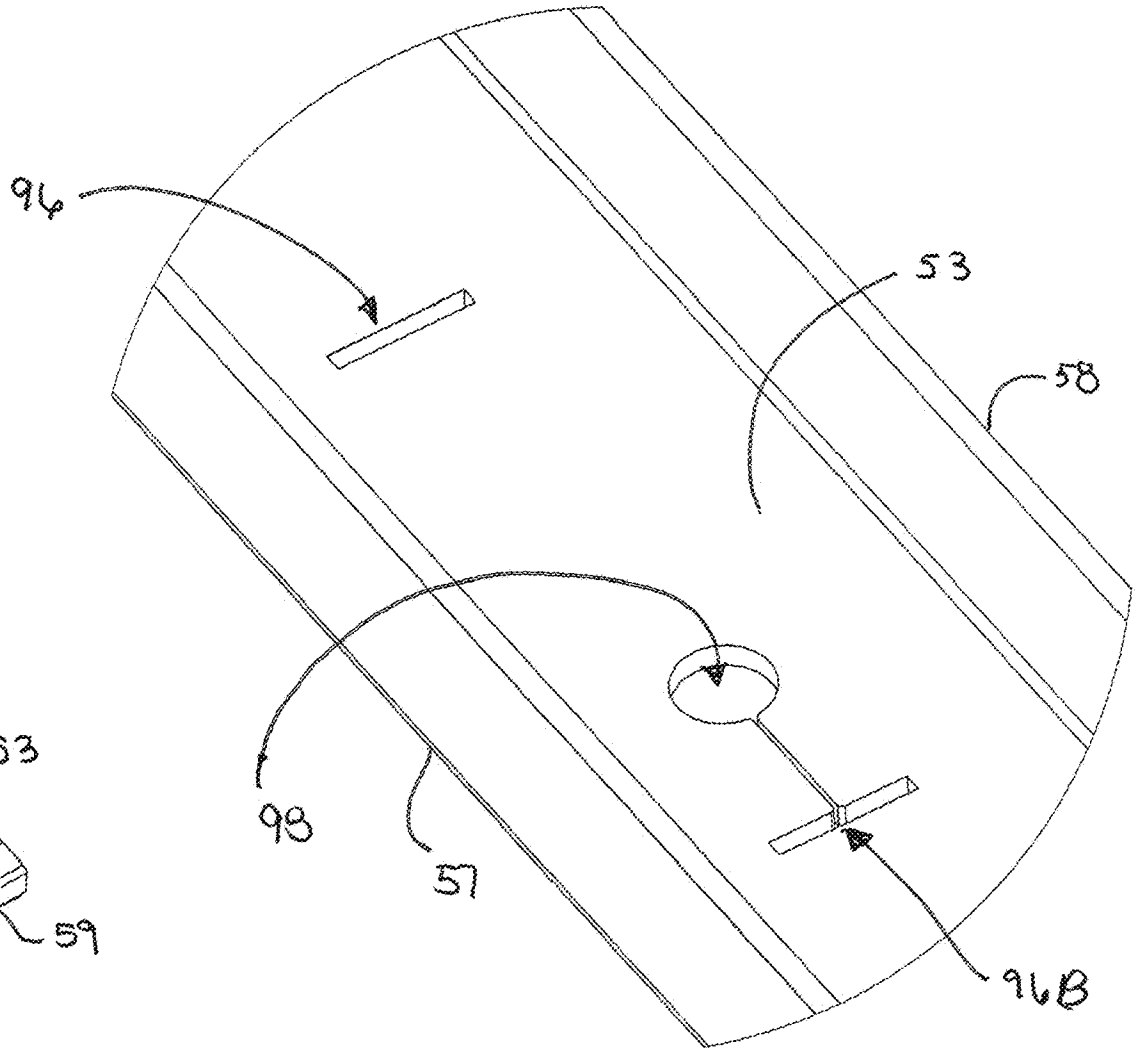
FIG. 9B is an enlarged bottom perspective view of the foot platform of FIG. 9A showing the locating slot and fastener aperture of the foot platform before the column assembly is coupled thereto.
Figure 9A:
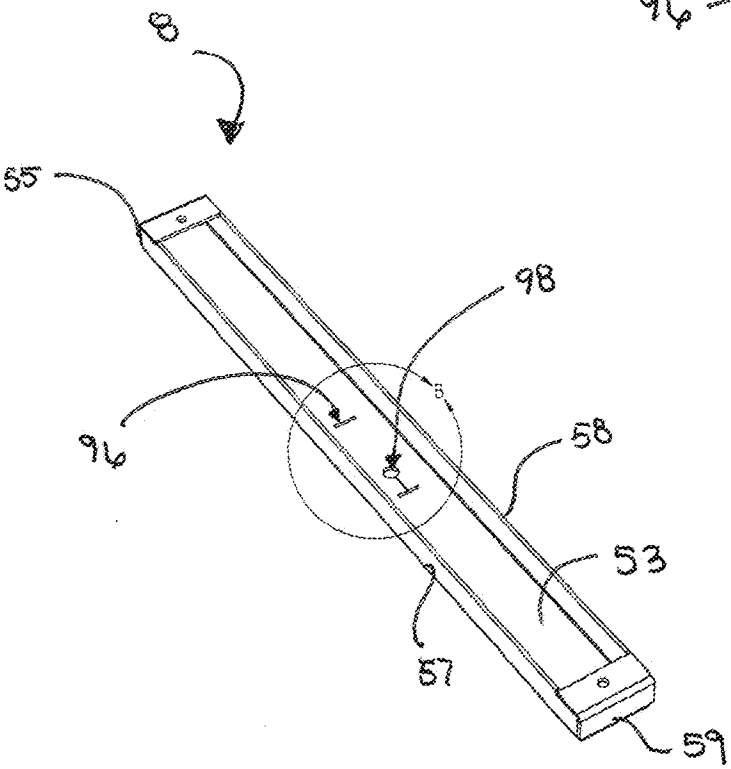
FIG. 9A is a bottom perspective view of the foot platform of FIG. 7.

The foot platform 8 includes a top surface 51, an underside surface 53 opposite the top surface 51, and four side surfaces 55, 57, 58, and 59, as illustrated in FIGS. 7 and 9A-9B, generally forming the perimeter of the foot platform 8. The foot platform 8 is further formed to include a locating slot 96 and a fastener aperture 98 configured to extend through the top surface 51 and the underside surface 53. The locating slot 96 and fastener aperture 98 are configured to permit locating and mounting of the first end 42 of the interior tube 40 to form the foot-and-column assembly 52. In illustrative embodiments, the locating slot 96 is positioned to be generally a distance D1 away from a center of the fastener aperture 98. In other embodiments, the foot platform may include an optional second locating slot 96B that is coupled or connected to the fastener aperture 98, as illustrated in FIGS. 9A-9B.

Figure 8B:
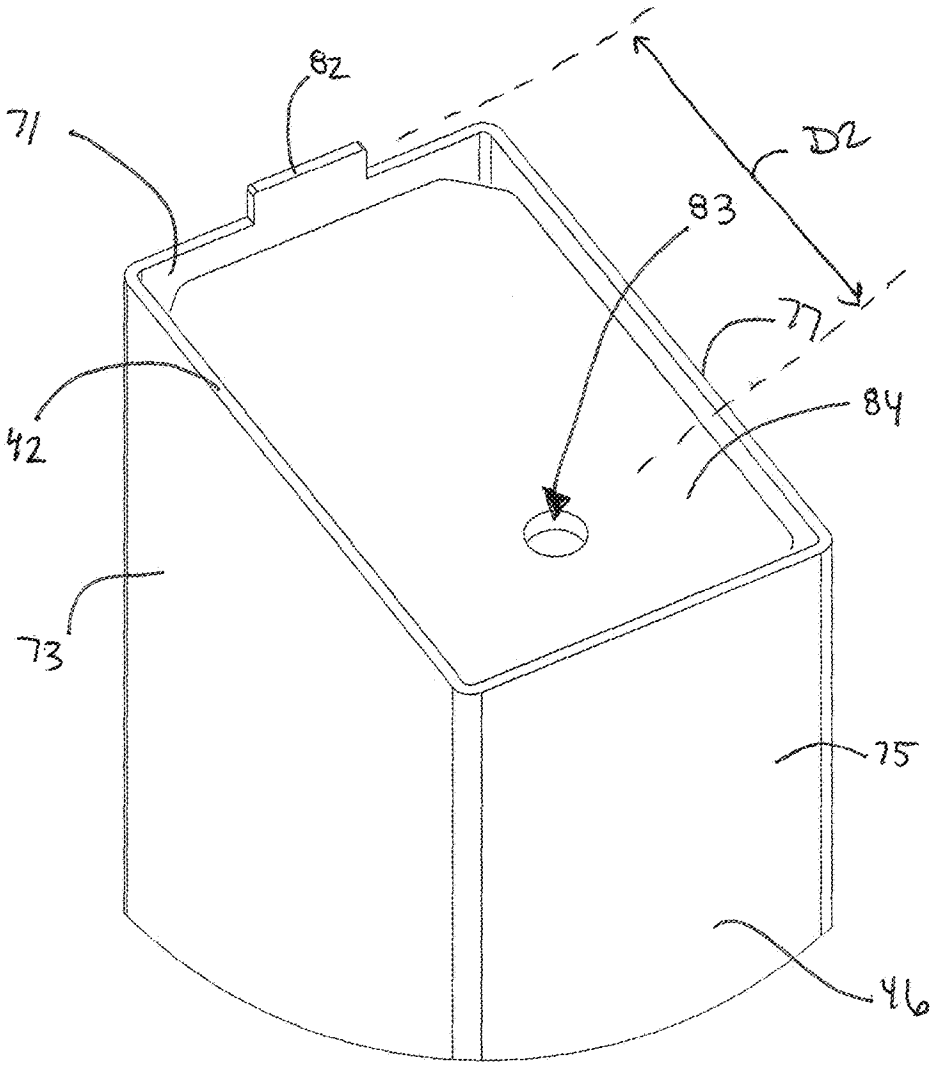
FIG. 8B is an enlarged bottom perspective view of the column assembly of FIG. 8A, illustrating the column assembly includes a locking tab and fastener aperture that is configured to permit the column assembly to be aligned with and fastened to the foot platform.
Figure 8A:
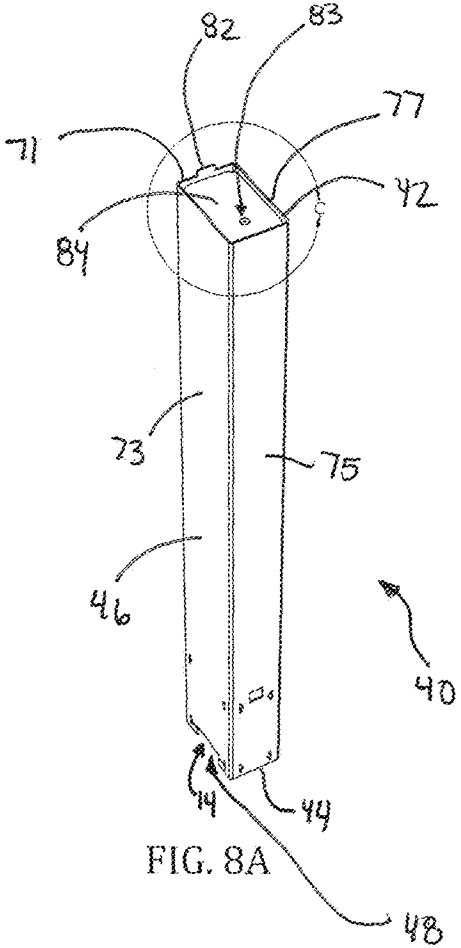
FIG. 8A is a bottom perspective view of a portion of the column assembly of FIG. 6B.

As mentioned, the interior tube 40 includes first end 42, second end 44, and tube housing 46 that extends between the first and second ends 42 and 44. The tube housing 46 includes four side surfaces 71, 73, 75 and 77, as illustrated in FIGS. 8A-8B, generally forming the perimeter of the interior tube 40. Each of the side surfaces 71, 73, 75 and 77 extend to the first and second ends 42 and 44. One of the side surfaces, such as surface 71, includes a locating tab 82 that extends past the first end 42 and is sized and configured to be received within the locating slot 96 when the interior tube 40 is properly aligned and placed against the top surface 51 of the foot platform 8 in order to secure the two components together. In this manner, the locating tab 82 and locating slot 96 are configured to indicate proper alignment of the components and to maintain them in generally proper alignment when the fastener 62 is used to securely lock the components together. In other embodiments, a second locating tab (not shown) may be optionally included in a side 75 of the tube housing 46 to be aligned with the second locating slot 96B of the foot platform assist with proper alignment as well.

The interior tube 40 further includes a mounting plate 84 that is positioned generally adjacent the first end 42 and configured to extend partially across the central passage 48 of the tube housing 46, as illustrated in FIGS. 8A-8B. The mounting plate 84 may completely cover the central passage 48, or may only partially cover the central passage 48, and is secured to the tube housing 46 via any known means such as welding, clips or crimping. The mounting plate 84 is formed to include a fastener aperture 83 that is configured to align with the fastener aperture 98 of the foot platform 8 when the interior tube 40 is coupled thereto. In illustrative embodiments, the distance between the locating tab 82 and the center of the fastener aperture 83 is configured to be a distance D2. In certain embodiments, distance D1 is the same as distance D2, although slight variations between the distances D1 and D2 may be envisioned to account for tolerances or variances, as may be necessary.

Figure 10B:
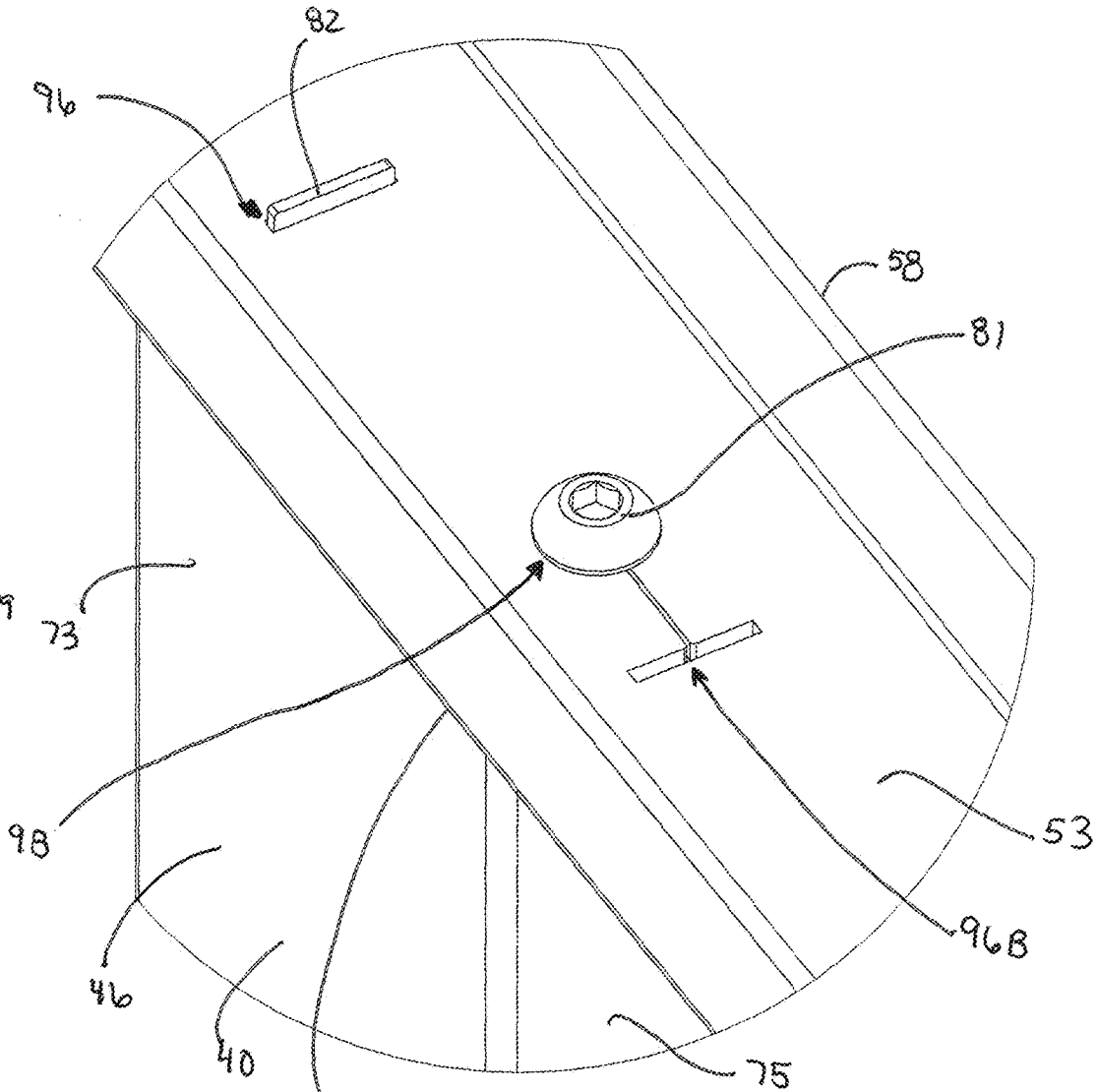
FIG. 10B is an enlarged bottom perspective view of the foot platform of FIG. 10A after the column assembly is coupled thereto to form the foot-and-column assembly.
Figure 10A:
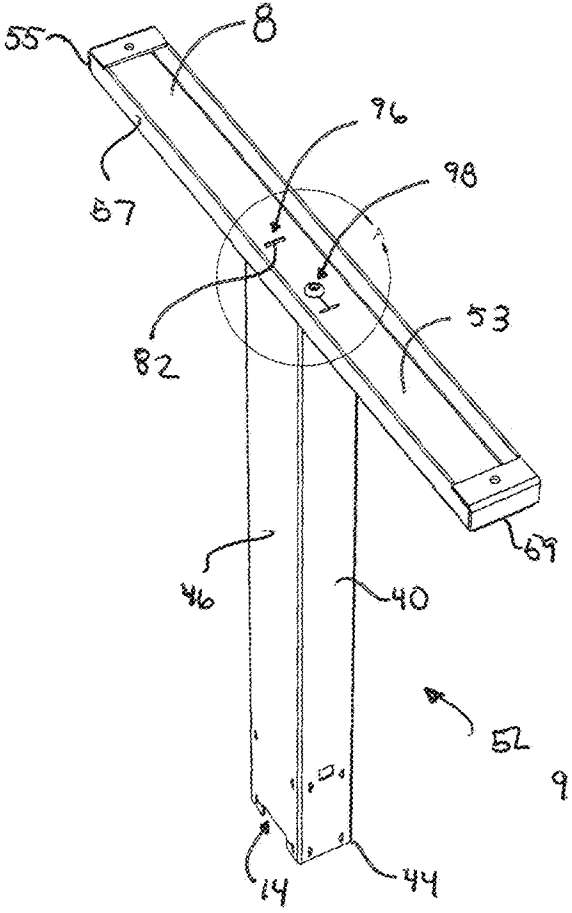
FIG. 10A is a bottom perspective view of the foot-and-column assembly of FIG. 6A.

To assemble the foot-and-column assembly 52, as illustrated in FIGS. 10A-10B, the interior tube 40 is positioned adjacent the foot platform 8 to align the locating tab 82 with the locating slot 96. The locating tab 82 is inserted into the locating slot 96, which properly aligns the interior tube 40 with the foot platform 8 for locking connection. In this proper alignment, the fastener 62 should be able to be inserted through both the fastener aperture 98 of the foot platform 8 and fastener aperture 83 of the interior tube 40 to secure the two components together in locked manner. A single fastener 62 may be utilized for such securement, while engagement of the locating tab 82 with the locating slot 96 will prevent rotational movement of the components with respect to each other about the single fastener location. In various embodiments, the fastener aperture 83 may also include a fastener receiver (e.g. nut or bolt component 81) to permit such securement from only the underside surface 53 of the foot platform 8, permitting more efficient or easier assembly. Other means of simplifying the fastening of the two components together are envisioned herein. Utilization of the locating tab 82 and locating slot 96 along with the fastener 62 in the fastener apertures 83 and 98 permit proper alignment and securement of the two components with reduced materials and assembly time.

The motor housing 22 is configure to receive the motor assembly. Typically, the motor assembly will comprise at least a motor, the spindle driver configured to mate with the spindle rod 54, and a motor attachment arm. The motor may be of any suitable design and configured to drive the spindle driver to rotate upon operation of the motor. In illustrative embodiments, the motor may be an electric motor powered via one or more electrical or power cords. The spindle driver is configured to engage with the spindle rod 54 in order to rotate the spindle rod 54. In illustrative embodiments, the spindle rod 54 may be hexagonal in shape adjacent the spindle driver, and the spindle driver may include a hexagonal-shaped aperture sized to receive the spindle rod 54. Accordingly, the spindle driver should be positioned to be axially aligned with the spindle rod 54, and may further be positioned along the spindle axis A.

Figure 11:
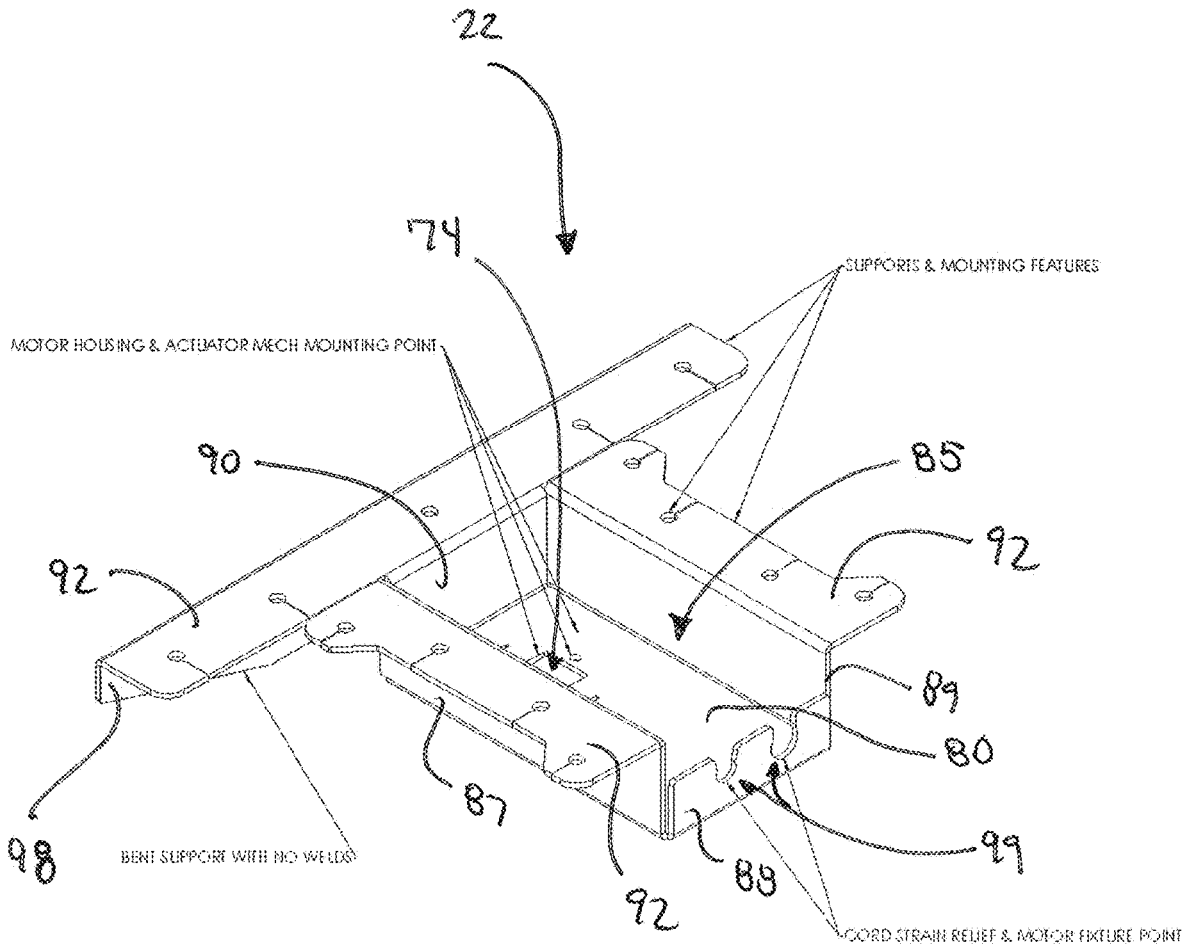
FIG. 11 is a top perspective view of a motor housing of a height-adjustable table of the present disclosure, illustrating the motor housing includes a motor-receiving section that permits clearance for a motor to be engaged with a spindle assembly that extends through an actuator opening within the motor-receiving section to rotate a spindle rod of the spindle assembly, the motor housing further including at least one support with mounting apertures configured to permit mounting of the motor housing on a bottom side of a top of the height-adjustable table.
Figure 12A:
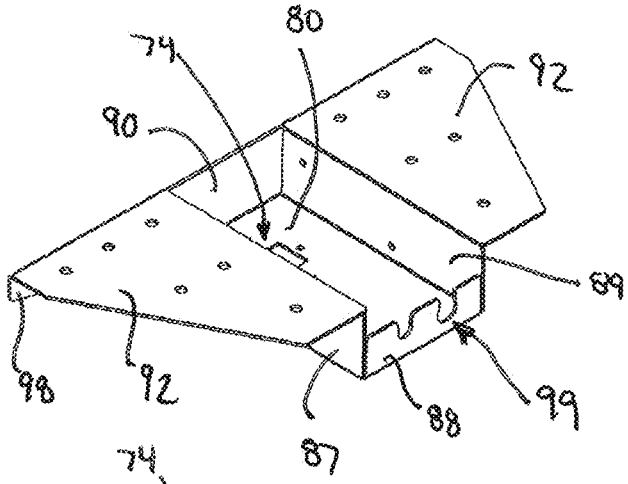
FIGS. 12A, 12B and 12C are top perspective views of alternative embodiments to the motor housing of FIG. 11.
Figure 12B:
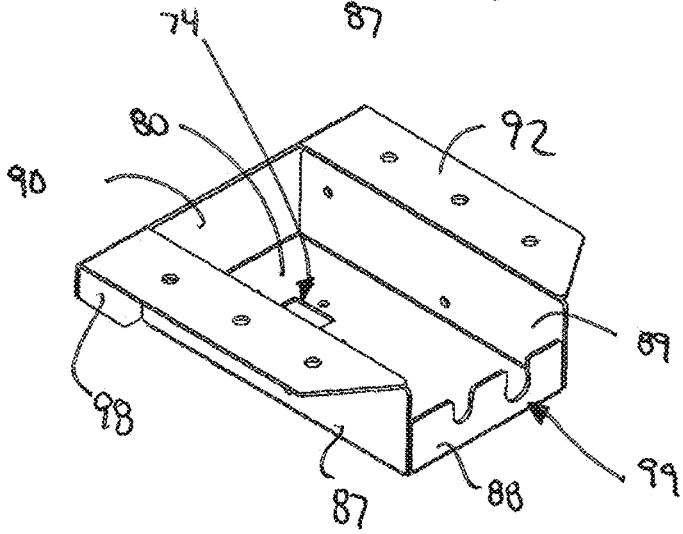
Figure 12C:
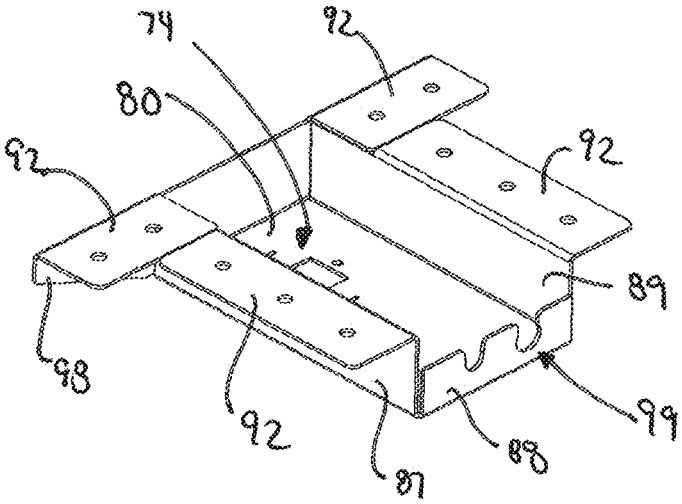

The motor housing 22 is configured to substantially suspend the motor within the motor housing 22. In illustrative embodiments, and as illustrated in FIGS. 11-12C, the motor housing may include a housing body 86 forming a motor receiving aperture 85 sized and configured to receive the motor assembly. The housing body 86 may be formed by the bottom side 80, and four housing sides 87, 88, 89, and 90 generally forming the perimeter of the housing body 86. The spindle aperture 74 extending through the bottom side 80 may be generally aligned with the spindle axis A. In order to avoid unnecessary downward force upon the spindle rod 54 from the motor, the motor may be coupled to a housing side 88 of the housing body 86, for instance via the motor attachment arm (not shown), as indicated in FIG. 11. The housing side 88 may include one or more connection apertures 99 to receive a portion of the motor attachment arm. Connection of the motor attachment arm to the side 88 permits the motor assembly to substantially float within the motor housing 22 but still remain stationary within the housing as the motor operates to apply rotational force upon the spindle rod 54 via the spindle driver.

The motor housing 22 may further include one or more support flanges 92 for maintaining the motor housing 22 in a fixed connection to the table top 2. The support flanges 92 may extend out from the housing body 86 adjacent one or more of the sides 85, 87 or 89, and may illustratively be co-formed with such sides and made of the same material as the sides. As illustrated in FIGS. 12A-12C, a variety of shapes and sizes of the support flanges 92 are envisioned herein. Additionally, a support arm 98 may be positioned along one or more of the support flanges 92 and/or the housing body 86 to provide additional structural support for the motor housing 22.

The length-adjustment support 10 may be assembled in a variety of ways. Illustratively, and as suggested in FIG. 3A, the spindle assembly 50 may be assembled first by inserting the spindle rod 54 into the spindle guide 68, and then the bushing member 65 and spindle plate 60 may be optionally attached to the spindle rod 54. The spindle assembly 50, specifically the spindle guide 68, may then be inserted into the spindle-assembly aperture 17 of the support panel 16 that has been coupled to the second end 44 of the interior tube 40. Alternatively, the spindle guide 68 may be inserted into the spindle-assembly aperture 17 of the support panel 16 before the support panel 16 is coupled to the second end 44 of the interior tube 40. The motor housing 22 is also fixedly coupled to the first end 32 of the exterior tube 30. A portion of the spindle assembly 50 may be inserted into the spindle aperture 74 of the motor housing 22 to extend within the motor housing 22. During this process, the bushing member 65 may be coupled to the rest of the spindle assembly 50 within the motor housing 22 and then be inserted into the spindle aperture 74 to frictionally engage with the bottom side 80 of the motor housing 22, retaining the spindle rod 54 in a fixed positioned relative to the motor housing 22. The interior tube 40 may then be coupled to the foot platform 8 as described above. The motor assembly may then be inserted into the motor housing 22 such that the spindle driver of the motor assembly aligns with the first end 61 of the spindle rod 54 exposed within the motor housing 22. Other means of assembling the length-adjustable support 10 are envisioned herein.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected.

What is claimed is:

1. A telescopic column assembly comprising:

an exterior column formed to include a central passage, the exterior column including a first end and a second end;

an interior column formed to be received within the central passage of the exterior column and including a second central passage, the interior column including a first end and a second end; and a spindle assembly comprising:

a spindle rod including a first end and a second end, wherein the first end of the spindle rod is retained in a fixed position adjacent the first end of the exterior column;

a spindle guide formed to include a spindle rod aperture, the spindle rod threadably engaging with the spindle rod aperture to permit the spindle guide to move along the spindle rod by rotation of the spindle rod; and a support panel securing the spindle guide to the first end of the interior column wherein the spindle guide is configured to extend through a spindle aperture in the support panel, and wherein the spindle guide includes an abutment ledge that abuts against a top surface of the support panel when the spindle guide extends through the spindle aperture;

wherein rotation of the spindle rod causes the distance between the first end of the exterior column and the first end of the interior column to increase, thereby causing the interior column to telescope out of the central passage of the exterior column, wherein the assembly further includes a retainer clip configured to partially surround the spindle guide and retain the spindle guide in the spindle aperture, the retainer clip configured to abut against a bottom surface of the support panel when the spindle guide extends therethrough.

2. The column assembly of claim 1, wherein the retainer clip is generally a C-shaped clip that is made of flexible material.

3. The column assembly of claim 2, wherein the retainer clip includes two teeth adjacent the ends of the retainer clip, each tooth configured to be received within a groove formed in a side surface of the spindle guide after the spindle guide is received within the spindle aperture.

4. A motorized length-adjustable support comprising:

a motor assembly;

a motor housing configured to support the motor assembly; and a telescopic column assembly comprising:

an exterior tube coupled to the motor housing, the exterior tube including a central passageway;

an interior tube that is configured to telescope into and out of the central passageway of the exterior tube, the interior tube formed to include a central passageway and including a support panel that extends across a portion of the central passageway; and a spindle assembly, the spindle assembly comprising:

a spindle guide secured to the support panel of the interior tube, the spindle guide formed to include a spindle aperture comprising threading, wherein the support panel includes a spindle-assembly aperture, and the spindle guide extends through the spindle-assembly aperture; and a spindle rod extending through the central passageway of the exterior tube and coupled to the motor assembly in the motor housing to be rotated by the motor assembly;

wherein the spindle rod is configured to extend through the spindle aperture of the spindle guide and threadingly engage with the spindle guide such that rotation of the spindle rod causes the spindle rod to travel through the spindle aperture, and wherein rotation of the spindle rod within the spindle guide causes the interior tube to telescope into and out of the central passageway of the exterior tube, wherein the spindle guide is secured within the spindle-assembly aperture by a retainer clip that extends around a portion of a circumference of the spindle guide.

5. The motorized length-adjustable support of claim 4, wherein the retainer clip includes at least one tooth that engages with a groove in a side surface of the spindle guide to connect the retainer clip to the spindle guide.

6. A motorized length-adjustable support comprising:

a motor assembly;

a motor housing configured to support the motor assembly; and a telescopic column assembly comprising:

an exterior tube coupled to the motor housing, the exterior tube including a central passageway;

an interior tube that is configured to telescope into and out of the central passageway of the exterior tube, the interior tube formed to include a central passageway and including a support panel that extends across a portion of the central passageway, wherein the interior tube includes a first end, a second end, and a tube housing extending between the first end and the second end, and wherein the first end is positioned between the second end and the motor housing; and a spindle assembly, the spindle assembly comprising:

a spindle guide secured to the support panel of the interior tube, the spindle guide formed to include a spindle aperture comprising threading;

a spindle rod extending through the central passageway of the exterior tube and coupled to the motor assembly in the motor housing to be rotated by the motor assembly; and a foot platform coupled to the second end of the interior tube, wherein the foot platform is not directly connected to the spindle assembly;

wherein the spindle rod is configured to extend through the spindle aperture of the spindle guide and threadingly engage with the spindle guide such that rotation of the spindle rod causes the spindle rod to travel through the spindle aperture, and wherein rotation of the spindle rod within the spindle guide causes the interior tube to telescope into and out of the central passageway of the exterior tube;

wherein the interior tube further includes a locating tab coupled to the tube housing adjacent the second end of the interior tube and wherein the locating tab is configured to align with and extend through a locating slot of the foot platform when coupling the foot platform to the interior tube.

7. A motorized length-adjustable support comprising:

a motor assembly;

a motor housing configured to support the motor assembly; and a telescopic column assembly comprising:

an exterior tube coupled to the motor housing, the exterior tube including a central passageway;

an interior tube that is configured to telescope into and out of the central passageway of the exterior tube, the interior tube formed to include a central passageway and including a support panel that extends across a portion of the central passageway, wherein the interior tube includes a first end, a second end, and a tube housing extending between the first end and the second end, and wherein the first end is positioned between the second end and the motor housing; and a spindle assembly, the spindle assembly comprising:

a spindle guide secured to the support panel of the interior tube, the spindle guide formed to include a spindle aperture comprising threading;

a spindle rod extending through the central passageway of the exterior tube and coupled to the motor assembly in the motor housing to be rotated by the motor assembly; and a foot platform coupled to the second end of the interior tube, wherein the foot platform is not directly connected to the spindle assembly;

wherein the spindle rod is configured to extend through the spindle aperture of the spindle guide and threadingly engage with the spindle guide such that rotation of the spindle rod causes the spindle rod to travel through the spindle aperture, and wherein rotation of the spindle rod within the spindle guide causes the interior tube to telescope into and out of the central passageway of the exterior tube;

wherein the interior tube further includes a mounting plate adjacent the second end of the interior tube that extends across a portion of the central passageway, the mounting plate including a tube fastener aperture to receive a fastener, and wherein the tube fastener aperture is configured to align with a foot fastener aperture extending through the foot platform to permit connection of the foot platform to the interior tube;

wherein the interior tube further includes a locating tab coupled to a first side of the tube housing along the second end of the interior tube, and wherein the fastener aperture of the mounting plate is adjacent a second side of the tube housing, and wherein the first and second sides are generally parallel to each other.

* * * * *